US012290149B2

(12) United States Patent
Büttner et al.

(10) Patent No.: US 12,290,149 B2
(45) Date of Patent: May 6, 2025

(54) CLOSURE DEVICE HAVING A ROTARY ELEMENT

(71) Applicant: Fidlock GmbH, Hannover (DE)

(72) Inventors: Heiko Büttner, Hannover (DE); Artur Siebert, Hannover (DE)

(73) Assignee: Fidlock GmbH, Hannover (DE)

( * ) Notice: Subject to any disclaimer, the term of this patent is extended or adjusted under 35 U.S.C. 154(b) by 174 days.

(21) Appl. No.: 17/774,238

(22) PCT Filed: Oct. 29, 2020

(86) PCT No.: PCT/EP2020/080417
§ 371 (c)(1),
(2) Date: May 4, 2022

(87) PCT Pub. No.: WO2021/089409
PCT Pub. Date: May 14, 2021

(65) Prior Publication Data

US 2022/0386742 A1 Dec. 8, 2022

(30) Foreign Application Priority Data

Nov. 5, 2019 (DE) ..... 10 2019 217 036.6

(51) Int. Cl.
*A43C 11/16* (2006.01)
*A45C 13/00* (2006.01)
*B65D 33/25* (2006.01)

(52) U.S. Cl.
CPC ..... *A43C 11/165* (2013.01); *A45C 13/001* (2013.01); *B65D 33/25* (2013.01)

(58) Field of Classification Search
CPC ..... A43C 11/165; A43C 11/08; A45C 13/001; B65D 33/25; B65D 33/00; B65D 33/16
See application file for complete search history.

(56) References Cited

U.S. PATENT DOCUMENTS 8,434,200 B2 * 5/2013 Chen ..... A42B 3/145 2/418
11,492,228 B2 * 11/2022 Kruse ..... B65H 75/30
(Continued)

FOREIGN PATENT DOCUMENTS

CN 105934174 A 9/2016
CN 108354269 A 8/2018
(Continued)

*Primary Examiner* — David M Upchurch
(74) *Attorney, Agent, or Firm* — The Webb Law Firm

(57) ABSTRACT

It is provided a closure device includes a first closure part and a second closure part, which can be placed against each other along a closing direction, are held against each other in a closed position, and can be detached from each other for opening the closure device. The second closure part includes a housing element with a bearing opening and a rotary element rotatably mounted in the bearing opening of the housing element. The rotary element is operatively connected to an actuator element and can be rotated with respect to the second closure part for adjusting the actuator element along a winding direction. The first closure part includes a first toothing device the second closure part includes a second toothing device, and in the closed position of the closure device the first toothing device and the second toothing device are in engagement with each other in such a way that the first closure part and the second closure part are positively held against each other along the winding direction.

17 Claims, 24 Drawing Sheets

(56) References Cited

U.S. PATENT DOCUMENTS

| | | | | |
|---|---|---|---|---|
| 11,712,082 | B2 * | 8/2023 | Gangadhar | A42B 3/14 2/418 |
| 11,849,810 | B2 * | 12/2023 | Chen | A43C 11/16 |
| 2002/0178548 | A1 | 12/2002 | Freed | |
| 2009/0184189 | A1 | 7/2009 | Soderberg et al. | |
| 2009/0211385 | A1 * | 8/2009 | Fiquepron | A42B 3/145 74/422 |
| 2013/0269219 | A1 * | 10/2013 | Burns | A43C 7/08 242/395 |
| 2015/0076272 | A1 * | 3/2015 | Trudel | A43C 11/165 242/381.4 |
| 2016/0120267 | A1 * | 5/2016 | Burns | A43C 7/00 24/68 C |
| 2017/0000210 | A1 | 1/2017 | Bigolin | |
| 2017/0265576 | A1 | 9/2017 | Beers et al. | |
| 2017/0303643 | A1 * | 10/2017 | Converse | A61F 5/0118 |
| 2018/0160775 | A1 * | 6/2018 | Pollack | A43C 11/165 |
| 2019/0008236 | A1 | 1/2019 | Ha et al. | |
| 2020/0008534 | A1 * | 1/2020 | Lovett | A43C 11/165 |
| 2020/0069002 | A1 * | 3/2020 | Fiedler | A42B 3/145 |

FOREIGN PATENT DOCUMENTS

| | | | |
|---|---|---|---|
| CN | 108377640 | A | 8/2018 |
| CN | 108778031 | A | 11/2018 |
| DE | 102018201019 | A1 | 8/2018 |
| EP | 3578069 | A1 | 12/2019 |
| JP | H07208 | A | 1/1995 |
| TW | 201429420 | A | 8/2014 |
| WO | 2015006616 | A1 | 1/2015 |
| WO | 2017000013 | A1 | 1/2017 |

* cited by examiner

CLOSURE DEVICE HAVING A ROTARY ELEMENT

CROSS-REFERENCE TO RELATED APPLICATIONS

This application is the United States national phase of International Application No. PCT/EP2020/080417 filed Oct. 29, 2020, and claims priority to German Patent Application No. 10 2019 217 036.6 filed Nov. 5, 2019, the disclosures of which are hereby incorporated by reference in their entirety.

BACKGROUND OF THE INVENTION

Field of the Invention

This disclosure relates to a closure device.

Description of Related Art

Such a closure device comprises a first closure part and a second closure part, which can be placed against each other along a closing direction, are held against each other in a closed position, and can be detached from each other for opening the closure device.

Such a closure device generally serves for connecting two parts to each other. For example, such a closure device can provide a closure for a container, for example a bag or a backpack. Such a closure device, however, can also serve for example as a closure for a shoe, e.g. a sports shoe. Quite generally, the closure device can serve for loadably connecting two arbitrary assemblies to each other.

It can be desirable here that such a closure device not only can be used for releasably connecting two parts to each other, but also provides for tensioning. For example, in a closure for a backpack or in a closure for a shoe it can be desirable that parts on the one hand can be placed against each other, but on the other hand can also be tensioned with respect to each other.

A tensioning device having a pulling element to be wound onto a rotary element is described for example in WO 2015/006616 A1.

SUMMARY OF THE INVENTION

An object underlying the proposed solution is to provide a closure device which on the one hand provides for releasably connecting assemblies to each other and possibly for tensioning the assemblies with respect to each other.

This object is achieved by a closure device having features as described herein.

Accordingly, the second closure part includes a housing element with a bearing opening and a rotary element rotatably mounted in the bearing opening of the housing element, wherein the rotary element is operatively connected to an actuator element and for adjusting the actuator element along a winding direction is rotatable relative to the second closure part, wherein the first closure part includes a first toothing device and the second closure part includes a second toothing device, and in the closed position of the closure device the first toothing device and the second toothing device are in engagement with each other in such a way that the first closure part and the second closure part are positively held with respect to each other along the winding direction.

The second closure part includes a housing element which forms a bearing opening in which the rotary element is mounted. The rotary element is operatively connected to an actuator element in such a way that the actuator element is adjusted by rotating the rotary element, and thus for example tensioning of an assembly, for example of a garment, can be effected.

The actuator element can be configured for example as a flexurally slack, flexible pulling element, via which tensile forces can be transmitted, but pushing forces can only be transmitted to a limited extent or not at all. The actuator element for example can be a rope, a belt, a ribbon, a strap, a chain or an (electrically conductive) cable. In this case, a closure for releasably connecting two parts to each other and a tensioning device are combined with the closure device. On the one hand, the closure device includes two closure parts which can be placed against each other along a closing direction and are held against each other in a closed position so that assemblies associated to the closure parts are connected to each other via the closure parts and their hold against each other, and the assemblies can also be detached again from each other by separating the closure parts. On the other hand, the second closure part includes a rotary element which in this case is configured as a winding element on which the actuator element is arranged. The rotary element for example can have the shape of a cylindrical roller and can carry a winding groove in which the actuator element can be received. Thus, the actuator element can be wound up and hence be tensioned by rotating the rotary element.

While the first closure part can be arranged on a first assembly, the second closure part can be connected to a second assembly via the actuator element, wherein by winding the actuator element onto the rotary element, the first assembly and the second assembly can be tensioned with respect to each other.

The actuator element for example can be attached to the rotary element with two ends so that by rotating the rotary element, the actuator element can be wound onto the rotary element with its two ends. It is, however, also conceivable and possible that merely one end of the actuator element is attached to the rotary element in order to wind up merely this one end by rotating the rotary element. Moreover, it is also conceivable and possible that an internal portion of the actuator element is arranged on the rotary element in order to wind up the actuator element by rotating the rotary element. And it is conceivable that a plurality of different actuator elements are arranged on the rotary element and can be wound up via the rotary element.

Alternatively, the actuator element can be formed by a rigid pushing element, for example in the form of a toothed rack, which can be adjusted by rotating the rotary element. Tensile forces and also pushing forces can be transmitted by such a rigid actuator element so that an adjustment of the actuator element by rotating the rotary element is possible in two directions, and a power transmission also is possible in two directions.

An actuator element in the form of a toothed rack for example can include a toothing formed thereon, which is in engagement with a toothing of the rotary element in such a way that by rotating the rotary element, the actuator element can be adjusted linearly with respect to the rotary element.

Such an actuator element in the form of a rigid pushing element can be guided for example on the housing element of the second closure part so that the actuator element is maintained in operative connection with the rotary element via the housing element, and thus a rotary movement of the rotary element leads to a introduction of force into the actuator element and thus to an adjustment of the actuator element on the housing element.

In one embodiment, the second closure part includes an actuating element which is operatively connected to the rotary element and can be actuated for rotating the rotary element. The actuating element for example can realize a handle for a user, which can be grasped by a user in order to thereby rotate the actuating element and thus the rotary element operatively connected to the actuating element. Thus, by actuating the actuating element, an adjustment of the actuator element can be effected, for example in order to tension an actuator element in the form of a pulling element or to adjust an actuator element in the form of a flexurally rigid toothed rack.

The actuating element for example can include an engagement device which is non-rotatably connected to an engagement device of the rotary element. The engagement device of the actuating element for example can be formed by a non-rotation-symmetrical pin which engages into an associated engagement opening of the rotary element and thus non-rotatably fixes the actuating element with respect to the rotary element.

In one embodiment, the rotary element includes an abutment portion with which the rotary element can be placed against the first closure part. In the closed position, the rotary element rests against the first closure part with the abutment portion so that the rotary element thereby is supported on the first closure part.

The actuating element preferably is arranged on a first side of the housing element, while the abutment portion is formed on a second side of the housing element facing away from the first side. For assembly, the rotary element for example can be inserted with a bearing body into the bearing opening of the housing element from the second side, while the actuating element is placed against the housing element from the first side and is operatively connected to the rotary element. Thus, the actuating element and the rotary element can be mounted on the housing element from different sides, which provides for an easy assembly by placing the parts against each other.

The first closure part and the second closure part each include a toothing device, which in the closed position of the closure device produce a positive hold with respect to each other along the winding direction of the closure parts. Positive hold here means that at least certain forces acting between the closure parts along the winding direction can be positively supported and dissipated without the closure parts thereby being adjusted with respect to each other along the winding direction. Such a positive hold can exist in the winding direction and also against the winding direction. It is, however, also conceivable and possible that forces are supported only in one direction, i.e. in the winding direction or against the winding direction.

The positive hold here can be designed such that in the closed position a movement of the second closure part relative to the first closure part is blocked against the winding direction and/or in the winding direction, i.e. the positive hold cannot be overcome easily, at least not without removing the second closure part from the first closure part. Alternatively, however, the positive hold can also be designed such that upon exceedance of a certain limit torque, which depends on the geometry of the toothing devices, the positive hold can be overcome so that on introduction of a force with which the limit torque is exceeded, the second closure part can be rotated with respect to the first closure part in the winding direction and/or against the winding direction.

The second toothing device (of the second closure part) for example can be formed on the actuating element or the rotary element. Thus, in the closed position a positive hold can be produced between the actuating element and the first closure part or between the rotary element and the first closure part.

Preferably, the toothing device of the second closure part is formed on the rotary element. On closing of the closure device by placing the closure parts against each other, the toothing device of the rotary element thus gets in meshing engagement with the toothing device of the first closure part so that the closure parts thereby are held against each other.

By means of the toothing devices, in particular a kind of freewheel can be provided, which provides for rotating of the second closure part with respect to the first closure part in the winding direction, when the closure parts are placed against each other and thus are in the closed position, but a movement against the winding direction is blocked. When the rotary element is rotated with respect to the first closure part, the second toothing device of the second closure part slides over the first toothing device of the first closure part so that a ratcheting movement of the second closure part with respect to the first closure part is possible in the winding direction.

When loaded against the winding direction, toothing elements of the toothing devices, however, get in engagement with each other in such a way that a movement is blocked, and the second closure part and hence also the rotary element are held in their position just taken.

The toothing devices can be in engagement with each other for example in an axial direction (by being placed against each other along the closing direction). When the second closure part is rotated in the winding direction with respect to the first closure part, the toothing devices slide over each other, for example in that sawtooth-shaped toothing elements slide onto each other. When the first closure part and the second closure part are rotatably mounted with respect to each other and are guided axially on each other, this can involve a (slight) axial movement of the second closure part with respect to the first closure part.

Alternatively, it can be provided that at least one of the toothing devices includes at least one toothing element, which upon rotation of the second closure part in the winding direction can be urged aside for example transversely to the winding direction. Thus, in this case there is no axial movement between the closure parts, but the toothing elements of one of the toothing devices are urged aside when the second closure part is rotated relative to the first closure part in the winding direction. This can be expedient in particular when the first closure part and the second closure part are mechanically latched with each other in the closed position and cannot be moved axially against each other.

In one embodiment, the first closure part includes a cylinder portion which in the closed position engages into an opening of the rotary element for rotatably mounting the rotary element on the first closure part. The first toothing device of the first closure part can be circumferentially extended around the surface portion. In this case, a rotatable support of the second closure part, in particular of the rotary element of the second closure part, on the first closure part is effected via the cylinder portion, so that by actuating the actuating element, the second closure part can be rotated in a simple way for example for winding the actuator element onto the rotary element, with the toothing devices of the first closure part and of the second closure part sliding over each other.

A closure device as described here can be configured as a purely mechanical closure device in which the closure parts are placed against each other and in the closed position are mechanically held against each other. Via such a mechanical hold, shear forces can be absorbed in a plane transverse to the closing direction and also, if necessary, forces against the closing direction in the case of mechanical latching between the closure parts.

In an advantageous embodiment, the closure device is of the magnetic type. For this purpose, the first closure part and the second closure part each include at least one magnetic element, which upon placement of the closure parts against each other face each other in a magnetically attracting way for closing the closure device, and thus magnetically support the closing of the closure device.

A magnetic element here can be formed by a permanent magnet or also by a magnetic armature, for example from a ferromagnetic material. For example, one of the closure parts can include a permanent magnet which cooperates with a magnetic armature of the other closure part in a magnetically attracting way. It is also conceivable, however, that both closure parts each include a permanent magnet or also an arrangement of several permanent magnets which on placement of the closure parts against each other oppose each other with unlike poles and thus support such placement by magnetic attraction.

Via magnetic elements which act between the first closure part and the second closure part in a magnetically attracting way and thus magnetically support the placement of the closure parts against each other, in particular the toothing devices of the closure parts can be pulled into engagement with each other so that in the closed position an engagement exists between the toothing devices.

For example, a magnetic element can be arranged on the rotary element, which on closing of the closure device cooperates with an associated magnetic element on the first closure part.

In one embodiment, the housing element includes a passage opening through which the actuator element is extended. When the actuator element is formed by a flexurally slack pulling element, the actuator element passes through the passage opening and extends through the passage opening out of the area of the bearing opening towards the outside in order to connect the actuator element to an object to be adjusted outside the bearing opening. When the rotary element on the other hand is formed by a rigid pushing element, for example in the form of a toothed rack, an operative connection between the actuator element and the rotary element can be produced via the passage opening, for example in that in the region of the passage opening the actuator element is in meshing engagement with a toothing of the rotary element.

The passage opening can be adjoined by a guiding device via which the actuator element is guided towards the passage opening so that the actuator element extends towards the housing element in a guided way. Via the passage opening in cooperation with the guiding device, the actuator element thus is guided towards the housing element and into the housing element in a defined way so that the actuator element, for example when designed as a flexurally slack pulling element, is supplied to the rotary element in a defined way.

In one embodiment, the closure device includes a tensioning element which is elastically deformable on adjustment of the actuator element. The tensioning element can be formed for example by a tube or a grommet and is elastically deformable on adjustment of the actuator element such that during an adjustment of the actuator element in one direction a tensioning force is effected on the tensioning element, which elastically supports resetting of the actuator element in an opposite, second direction.

The tensioning element can also be formed by a spring element, for example a metal spring, in particular a compression spring or tension spring.

The tensioning element can be arranged for example on the housing element, for example in that the tensioning element is connected to an engagement tab of the housing element, on which there is also formed a guiding device for guiding the actuator element.

The tensioning element can be arranged outside the bearing opening of the housing element and extend away from the housing element.

The tensioning element for example includes an interior space in which the actuator element is sectionally received so that the actuator element is guided in the tensioning element. The actuator element preferably is operatively connected to an end of the tensioning element located away from the housing element in such a way that an adjustment of the actuator element leads to an elastic deformation on the tensioning element, for example in that the end of the tensioning element located away from the housing element is pulled towards the housing element, and thus the tensioning element is deformed and tensioned under pressure.

The actuation of the actuating element can be effected manually by rotating the actuating element. However, embodiments in which there is provided an electric motor for driving the actuating element are also conceivable and possible. For example, such an electric motor can be stationarily arranged on an assembly connected to the first closure part and for example can get into engagement with a toothing of the actuating element via a suitable transmission element, for example a drive worm, when the closure device is in its closed position. Thus, the actuating element can be rotated via the electric motor.

Alternatively, it is conceivable and possible to electromotively drive the toothing device of the first closure part in order to rotate the rotary element by rotating the toothing device of the first closure part.

In one embodiment, one or more electrical contact elements can each be arranged on the first closure part and on the second closure part so that on closing of the closure device an electrical contact is made between the closure parts.

A closure device as described here can be employed in entirely different ways. For example, a closure device as described here can be employed in bags or other receptacles such as backpacks, chests or containers, in shoes (in particular sports shoes such as hiking shoes, ski boots or the like), in helmets, in particular sports helmets, or in medical aids such as medical support splints or the like.

For example, via a closure device as described here, straps on sacks or bags can be tensioned (so-called compression straps). A belt or a waist strap of a backpack or satchel can be closed and tensioned via such a closure device. And such a closure device can be employed on a cable drum for winding up an electrical cable, such as for example a headphone or charging cable.

Via a closure device as described here, a strap can be tensioned in a helmet, or an object can be attached to the helmet, for example protective goggles (such as ski goggles) or the like.

Such a closure device can be used for stowing and fastening accessories or bags in or on vehicles (bicycles, passenger cars, trucks, ships, airplanes etc.), for example as a tensioning device on a bike rack.

Concretely, such a closure device can be employed for example on a holder to be tensioned around a bicycle frame for fixing an assembly, for example a drinking bottle or a container, on the bicycle frame.

Moreover, such a closure device can serve for tensioning tarpaulins and cloths of any kind, for example for tensioning tent tarpaulins or also for tensioning a sunshade.

Military applications are also conceivable and possible. For example, a closure device can be used for cocking and stowing weapons and ammunition.

A closure device as described here can also be used in a tourniquet ligation system for ligating heavily bleeding wounds in a patient.

BRIEF DESCRIPTION OF THE DRAWINGS

The idea underlying the solution will be explained in detail below with reference to the exemplary embodiments illustrated in the Figures.

DESCRIPTION OF THE INVENTION

FIGS. 1A, 1B to 11A-11E show an exemplary embodiment of a closure device 1, in which closure parts 2, 3 can be placed against each other along a closing direction X and are held against each other in a closed position.

Figure 1A:
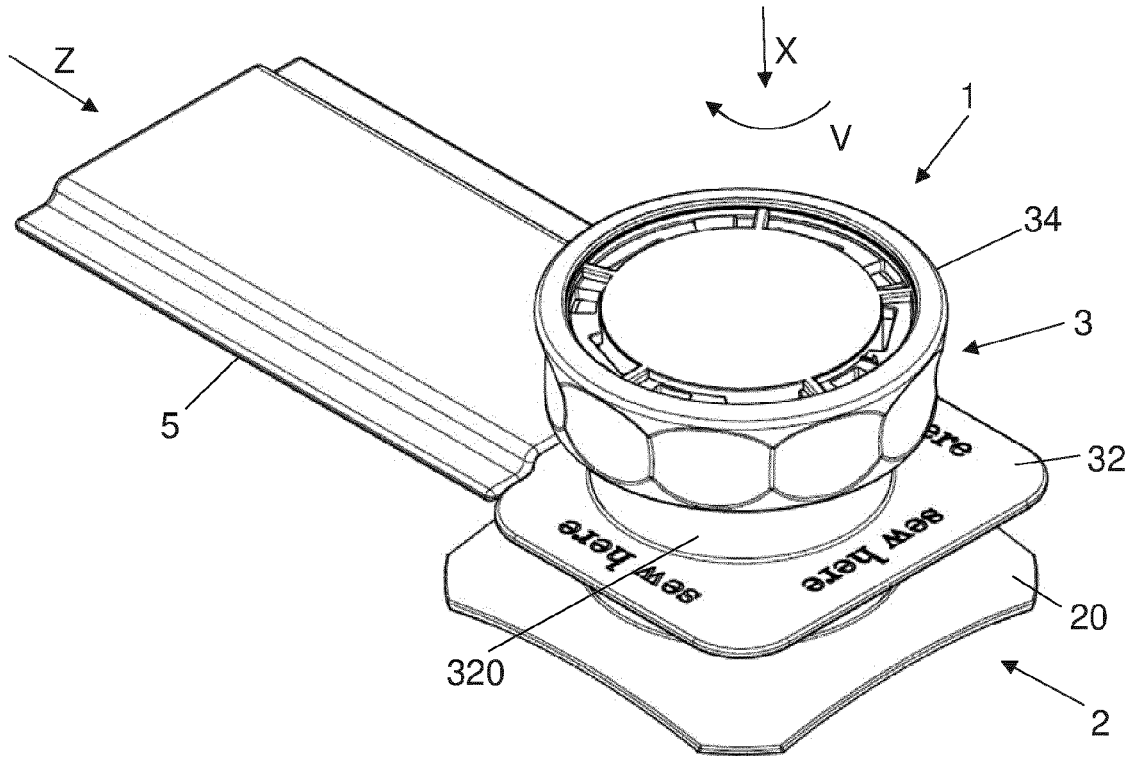
FIGS. 1A, 1B show views of a first exemplary embodiment of a closure device, comprising a first closure part, a second closure part, and a tensioning element arranged on the second closure part, in a non-tensioned position of the tensioning element.
Figure 1B:
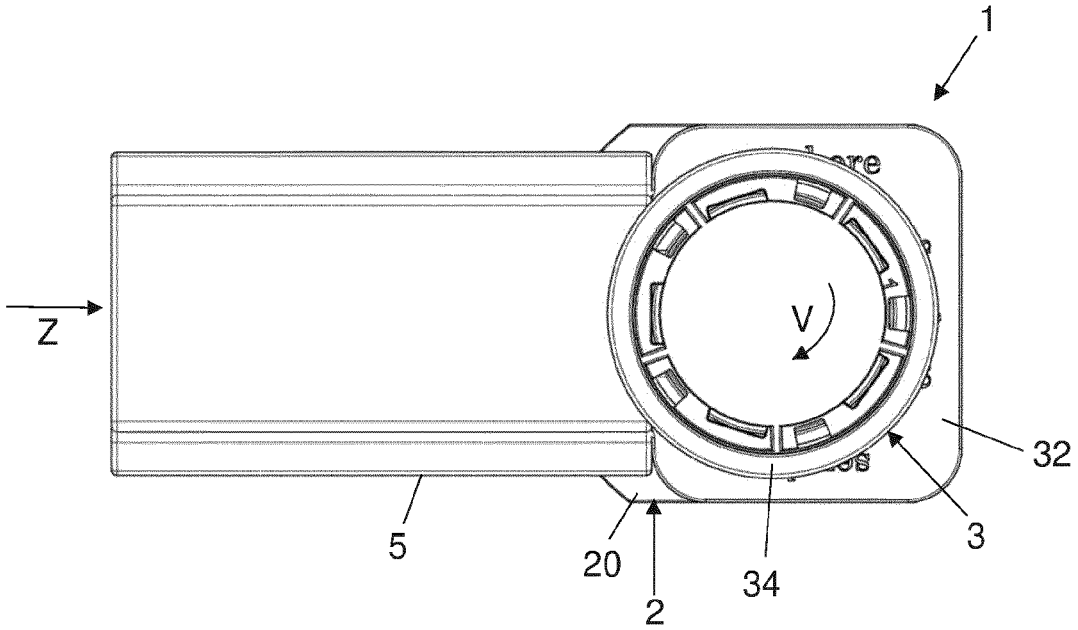
Figure 2A:
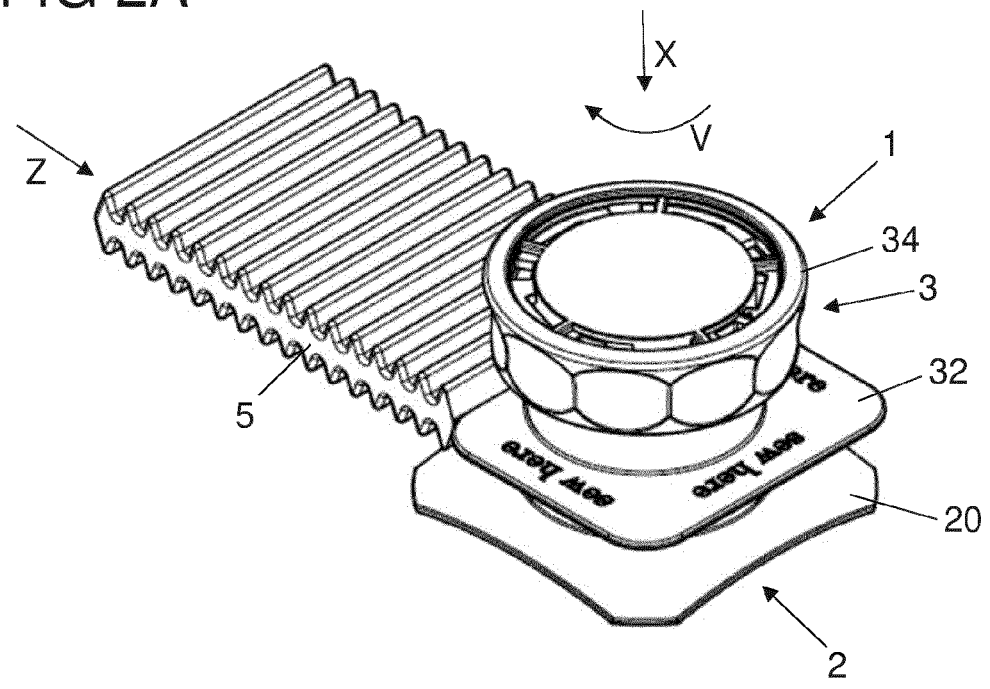
FIGS. 2A, 2B show views of the closure device, in a tensioned position of the tensioning element.
Figure 2B:
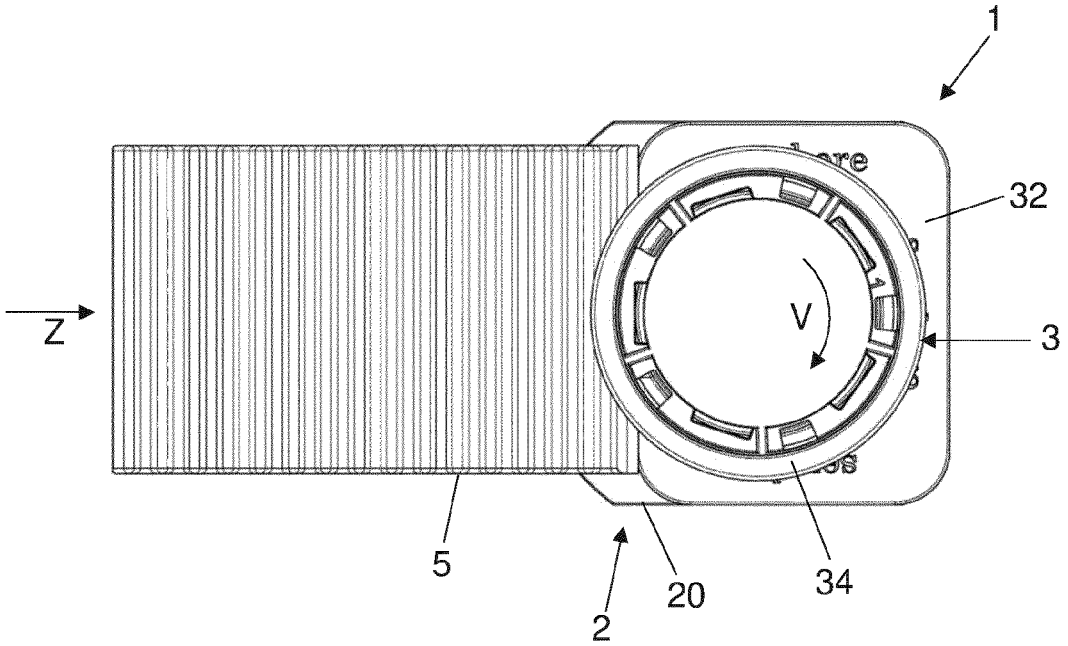
Figure 3:
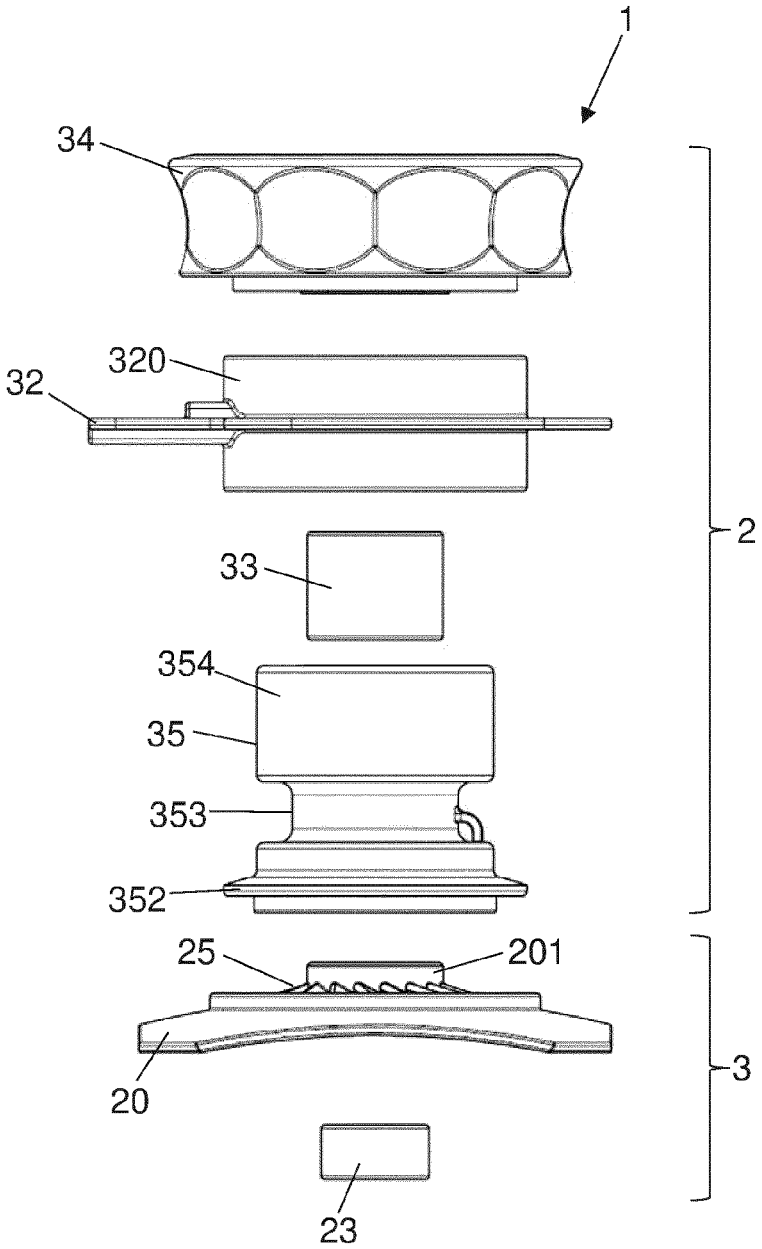
FIG. 3 shows an exploded view of the closure device, from the side.
Figure 4:
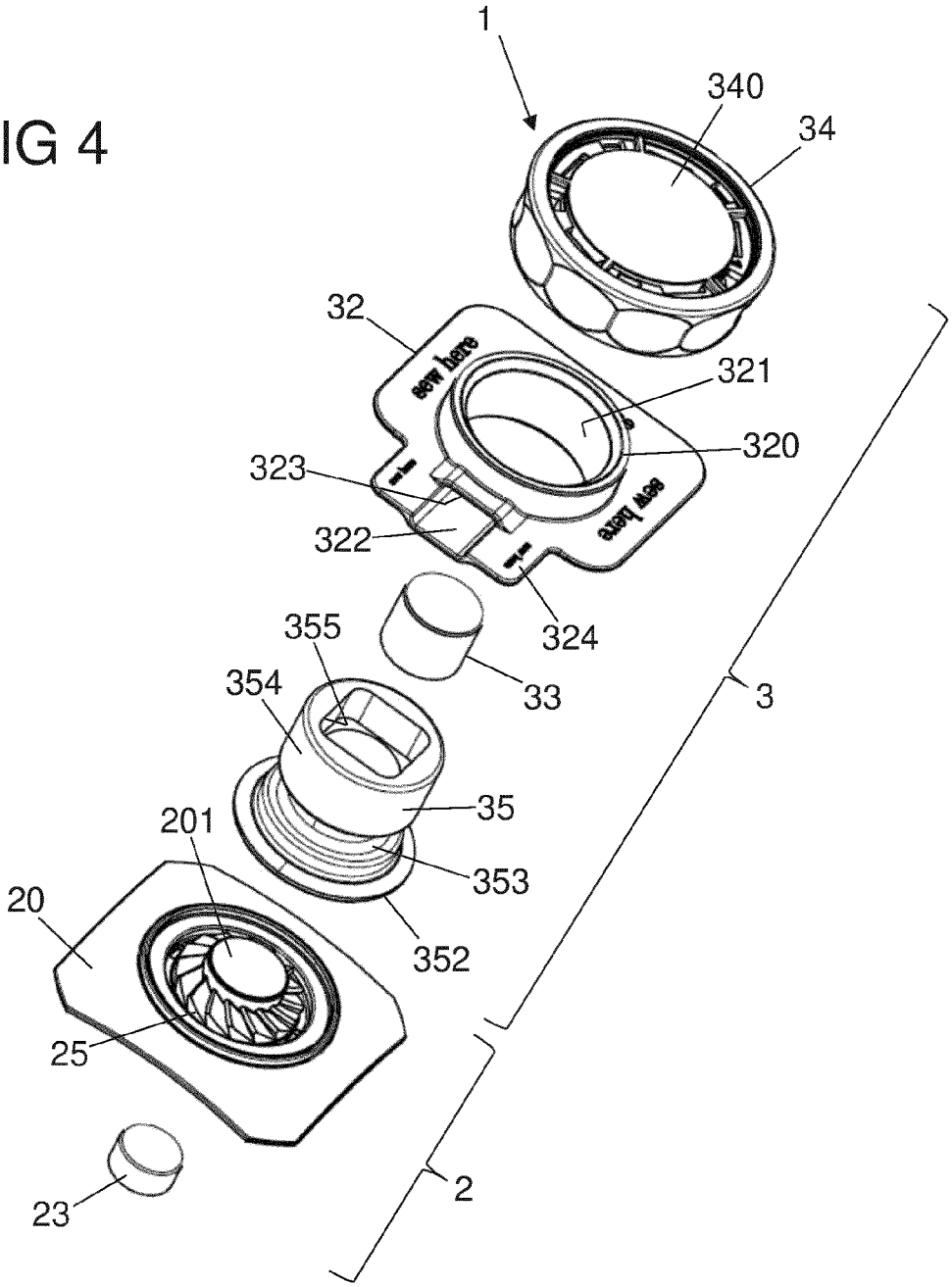
FIG. 4 shows a perspective exploded view of the closure device.
Figure 5:
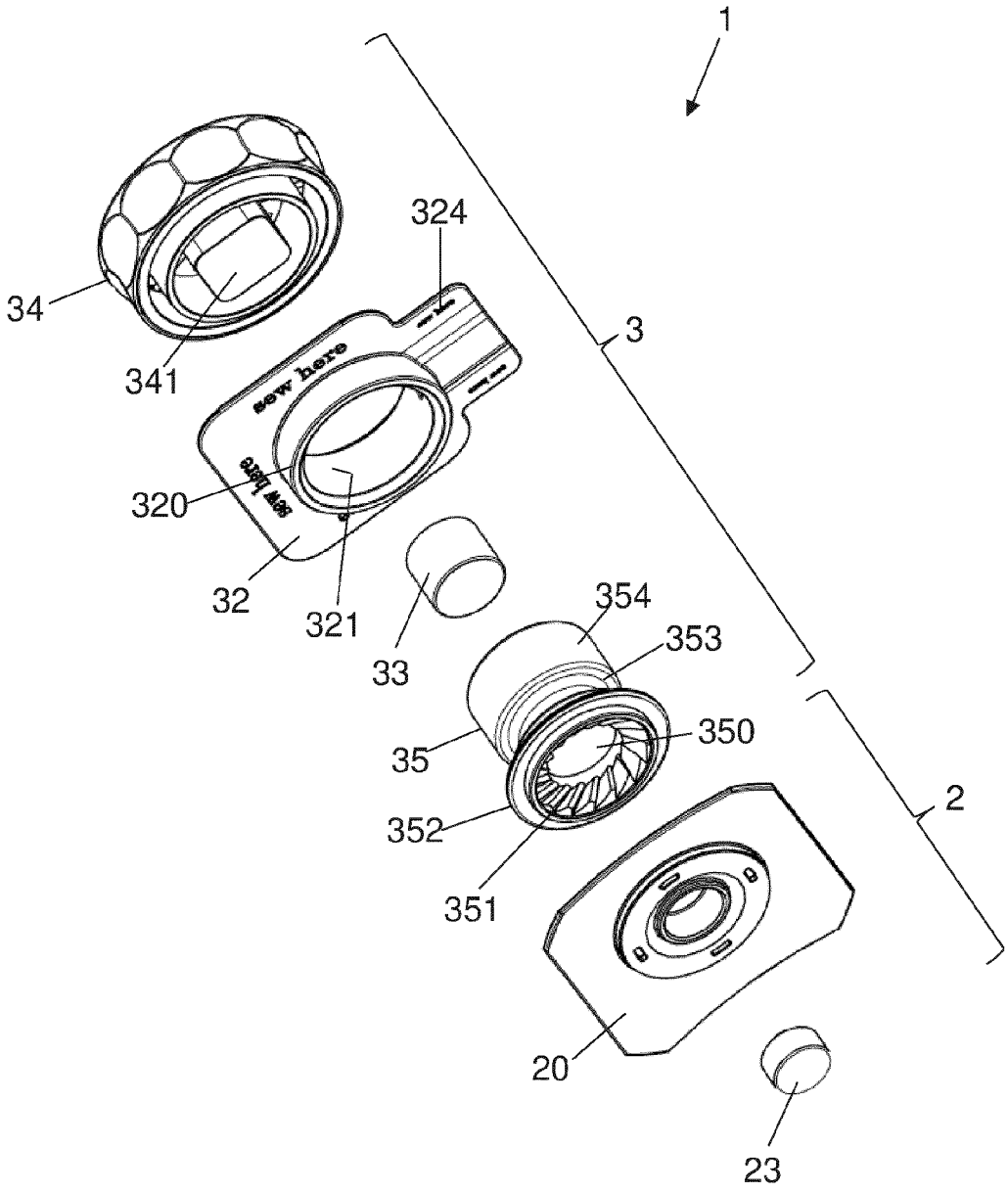
FIG. 5 shows another perspective exploded view of the closure device.
Figure 6A:
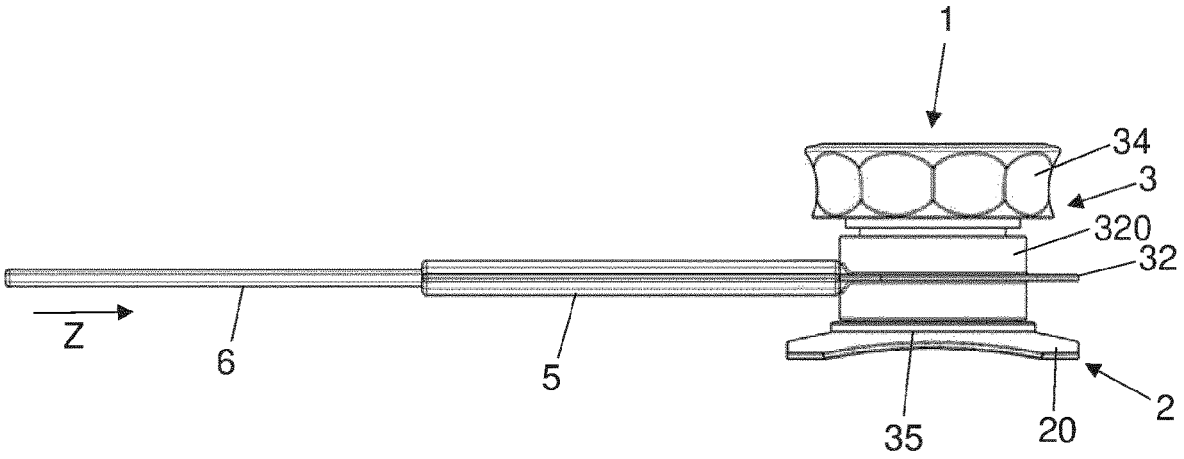
FIG. 6A shows a side view of the closure device in a closed position.
Figure 6B:
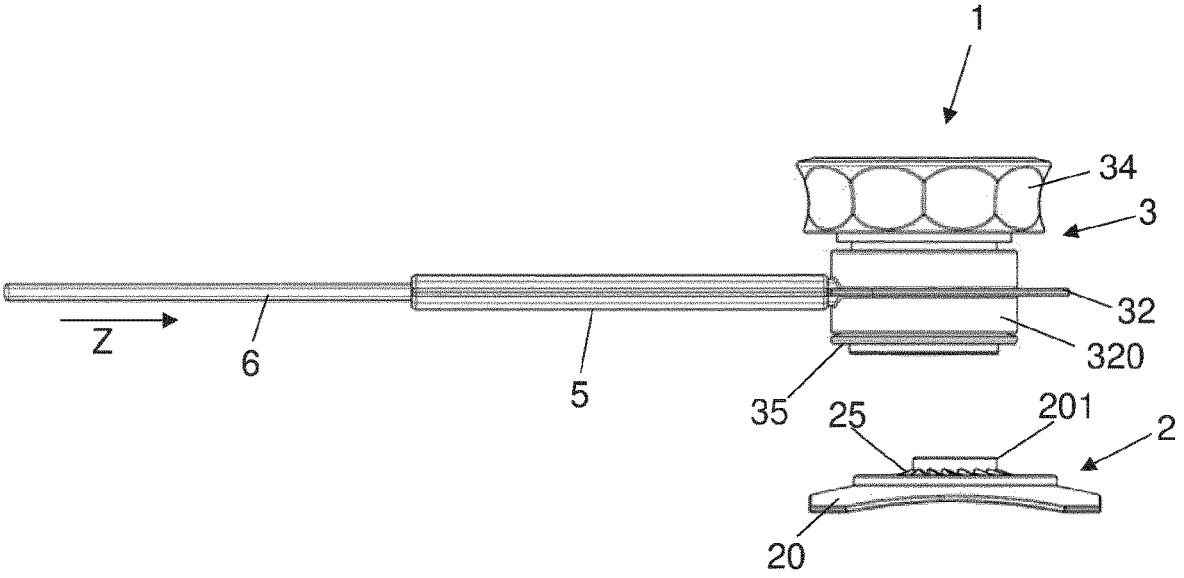
FIG. 6B shows a side view of the closure device in an open position.
Figure 7A:
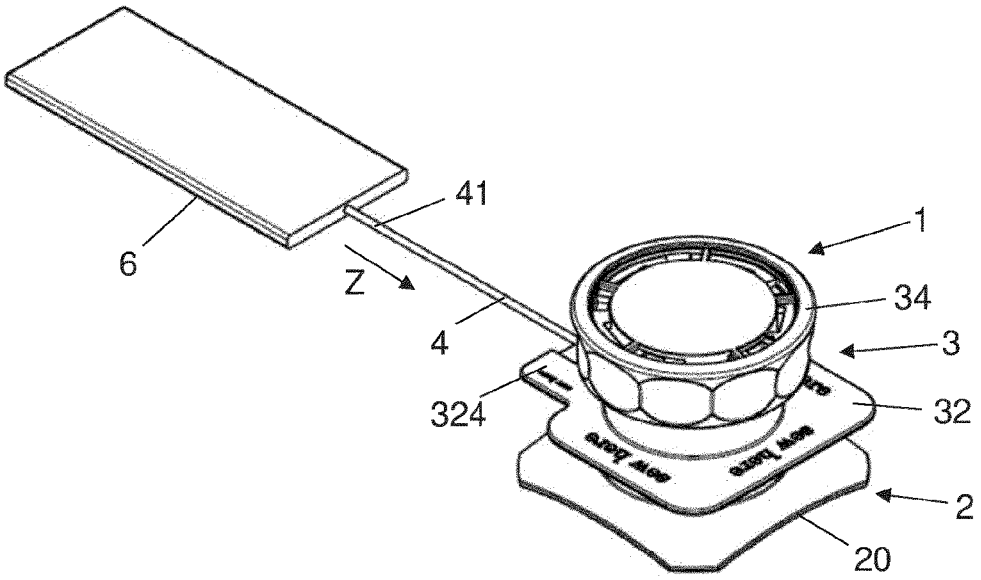
FIG. 7A shows a perspective view of the closure device in the closed position.
Figure 7B:
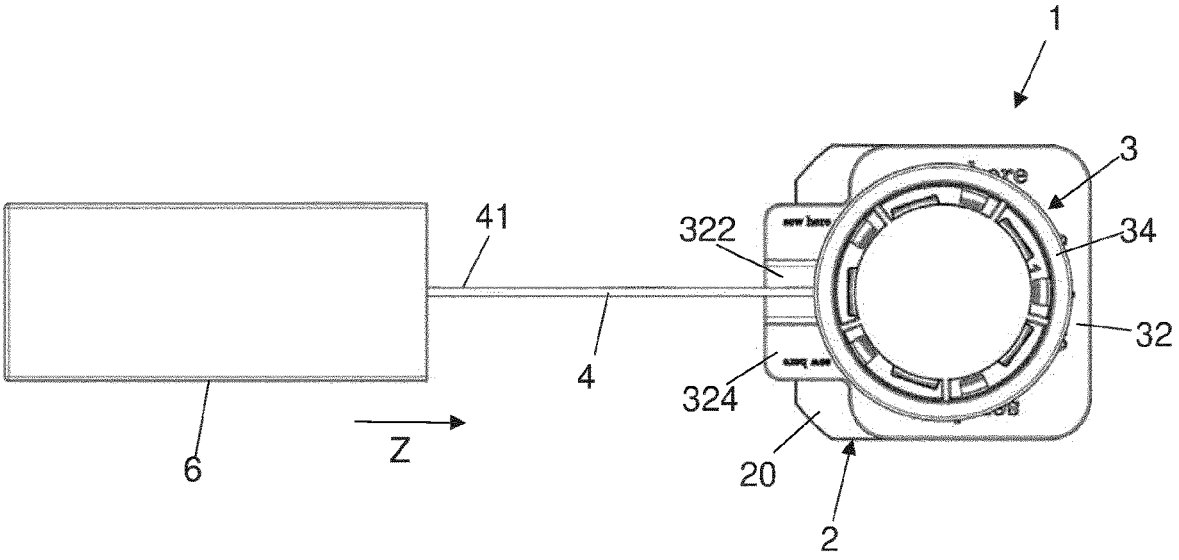
FIG. 7B shows a top view of the closure device, in the closed position.

As can be taken from the exploded view of FIGS. 3 to 5, the first closure part 2 has a base body 20 on which a cylinder portion 201 is formed. Around the cylinder portion 201 a toothing 25 extends, whose teeth have a sawtooth shape. On the base body 20, there is also arranged a magnetic element 23.

The second closure part 3 includes an actuating element 34 in the form of a handle and a rotary element 35 in the form of a winding element, which forms a groove 353 axially delimited by an abutment portion 352 in the form of an annular collar and a bearing body 354, in which groove an actuator element 4 in the form of a flexurally slack pulling element can be received for winding onto the rotary element 35.

On the rotary element 35 a magnetic element 33 is arranged, which cooperates with the magnetic element 23 on the first closure part 2 in a magnetically attracting way.

The rotary element 35 forms a cylindrical bearing body 354, which is received in a bearing opening 321 of a hollow cylindrical bearing collar 320 of a housing element 32 of the second closure part 3 and is rotatably mounted in the bearing opening 321.

The actuator element 4 in the form of the flexurally slack pulling element extends through a passage opening 323 in the bearing collar 320 from outside into the bearing opening 321 and is guided on a guiding device 322 in the form of a groove-shaped depression on an engagement tab 324 of the housing element 32 so that the actuator element 4 is supplied to the rotary element 35 in a defined way from outside via the passage opening 323 and runs into the groove 353 of the rotary element 35.

Figure 8A:
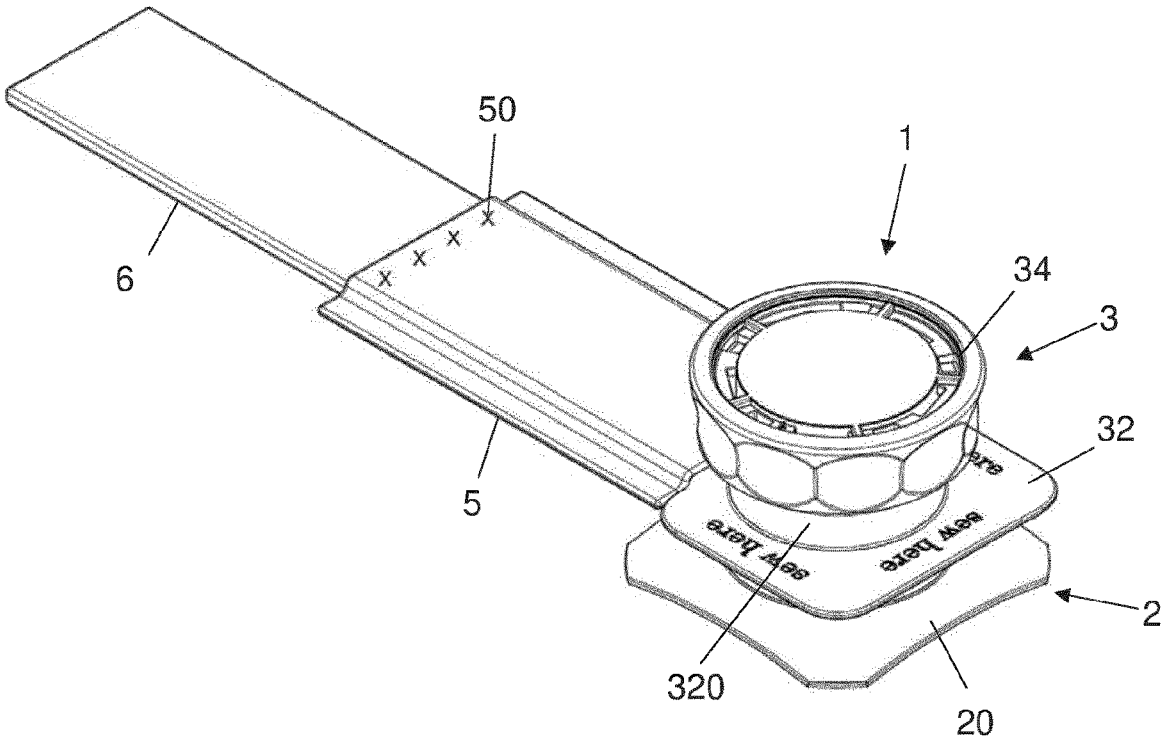
FIG. 8A shows a perspective view of the closure device in the closed position.
Figure 8B:
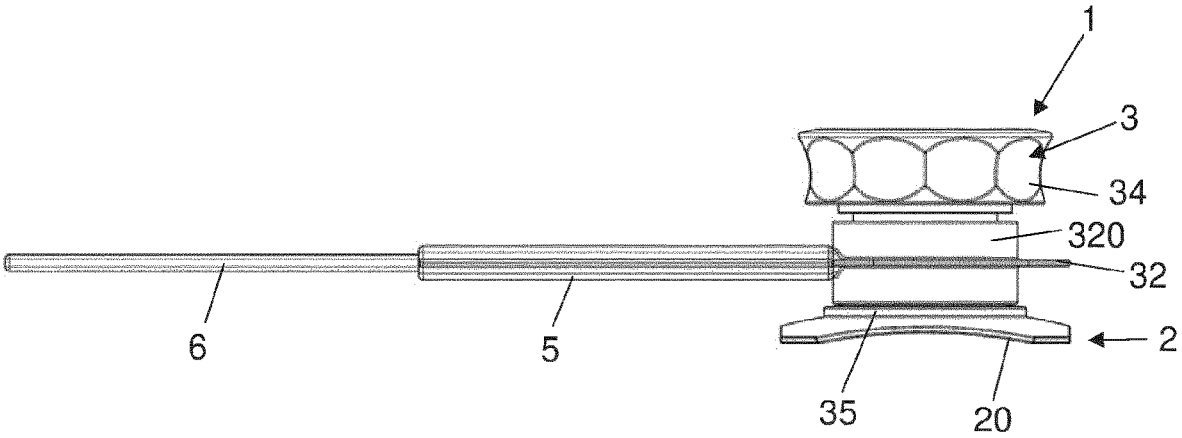
FIG. 8B shows a side view of the closure device in the closed position.
Figure 8C:
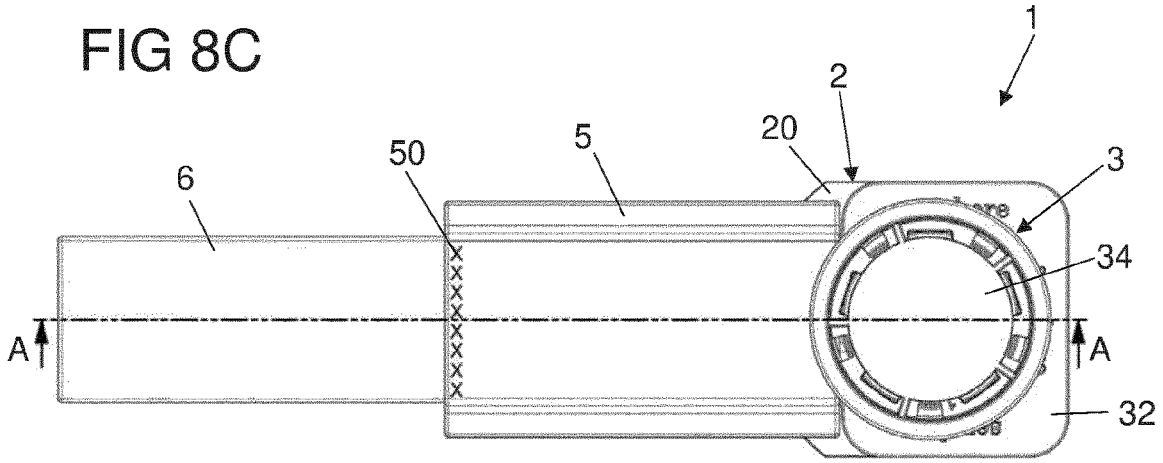
FIG. 8C shows a top view of the closure device in the closed position.
Figure 8D:
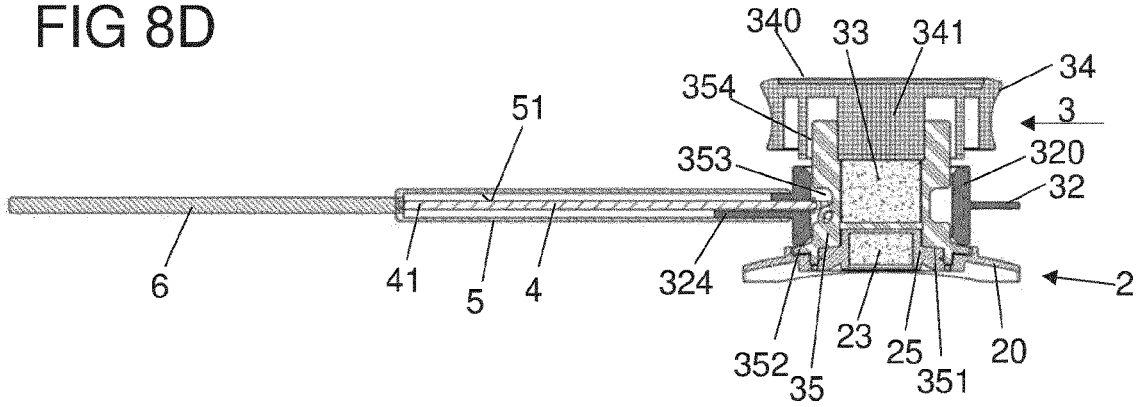
FIG. 8D shows a sectional view along line A-A of FIG. 8C.
Figure 8E:
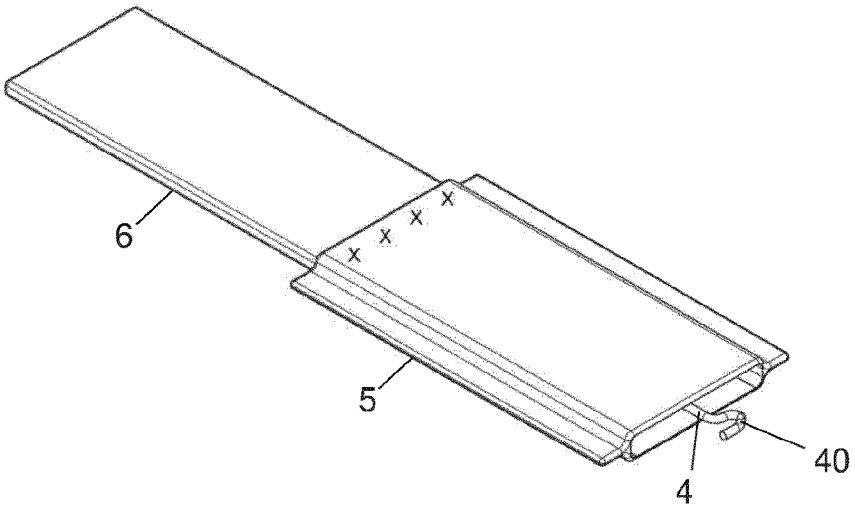
FIG. 8E shows a separate view of the tensioning elements of the closure device.
Figure 9A:
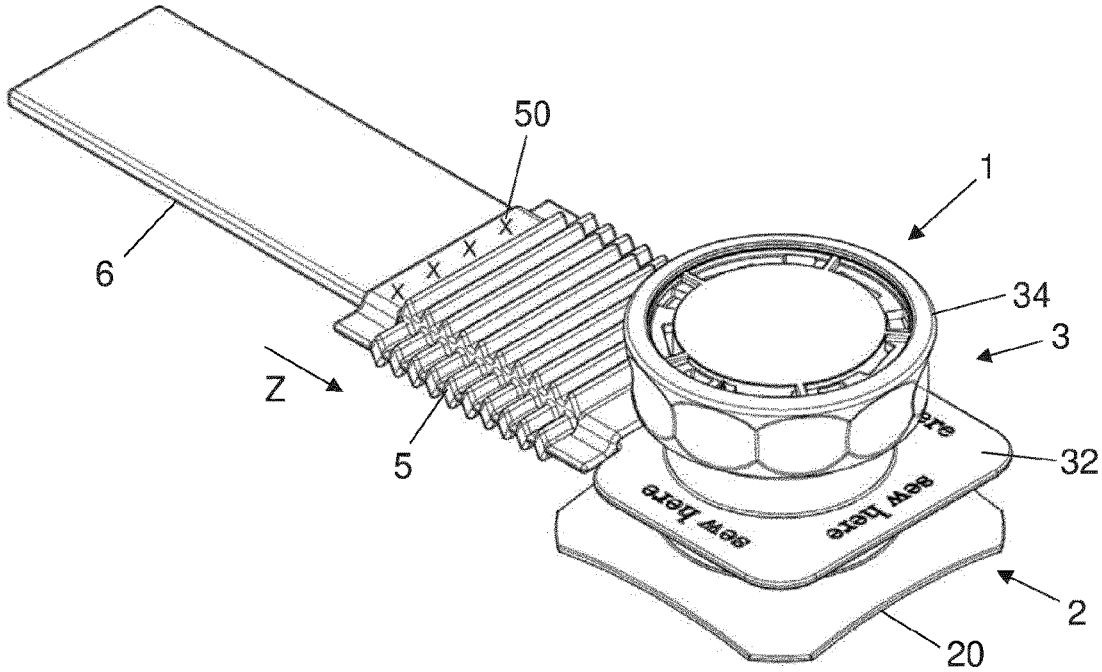
FIG. 9A shows a perspective view of the closure device, on tensioning of an actuator element in the form of a pulling element.
Figure 9B:
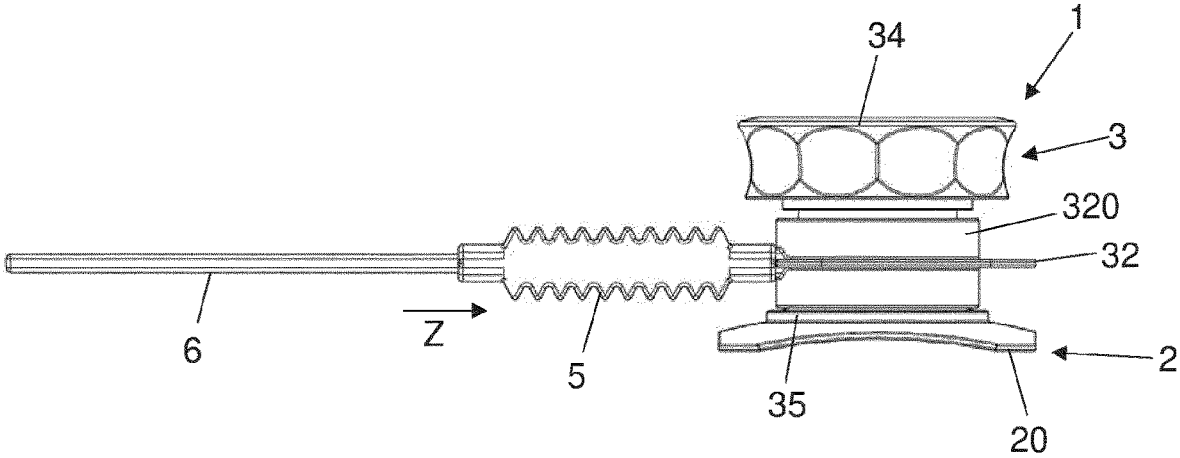
FIG. 9B shows a side view of the closure device, on tensioning of an actuator element in the form of a pulling element.
Figure 9C:
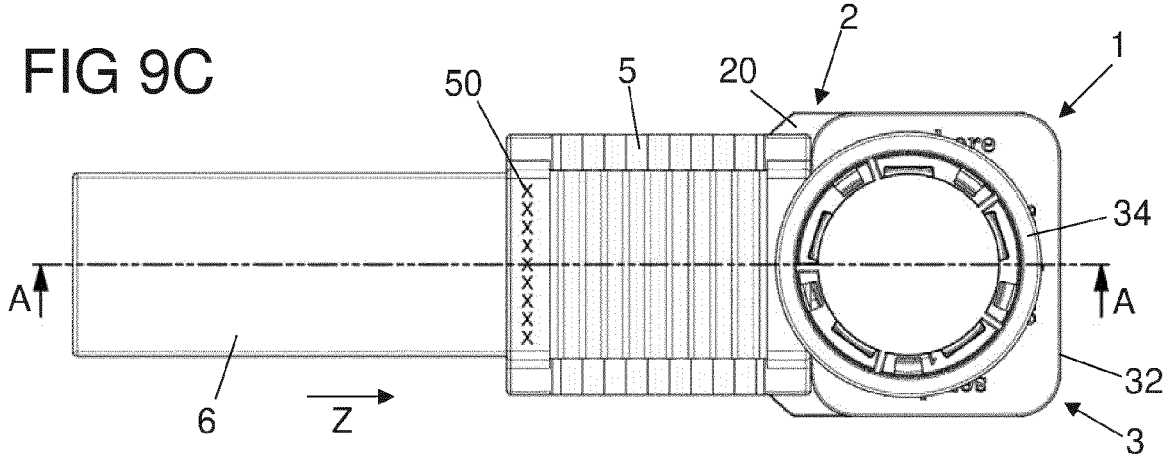
FIG. 9C shows a top view of the closure device, on tensioning of an actuator element in the form of a pulling element.
Figure 9D:
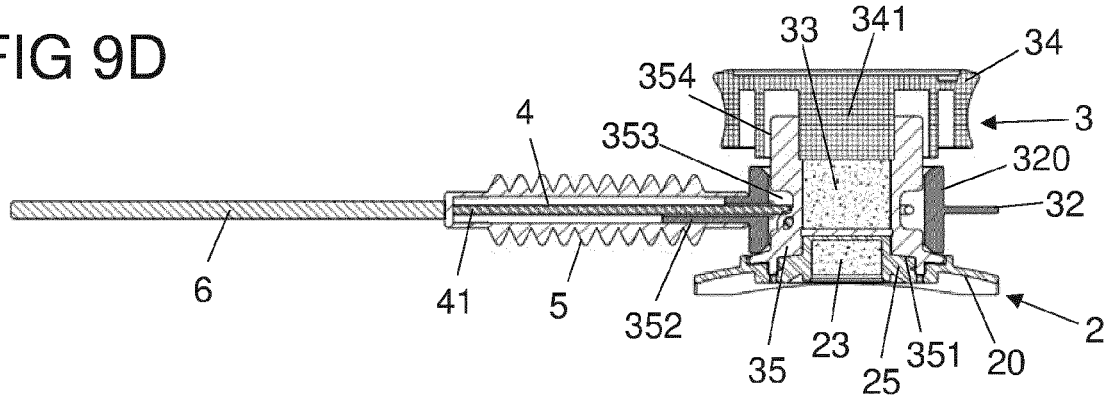
FIG. 9D shows a sectional view along line A-A of FIG. 9C.
Figure 9E:
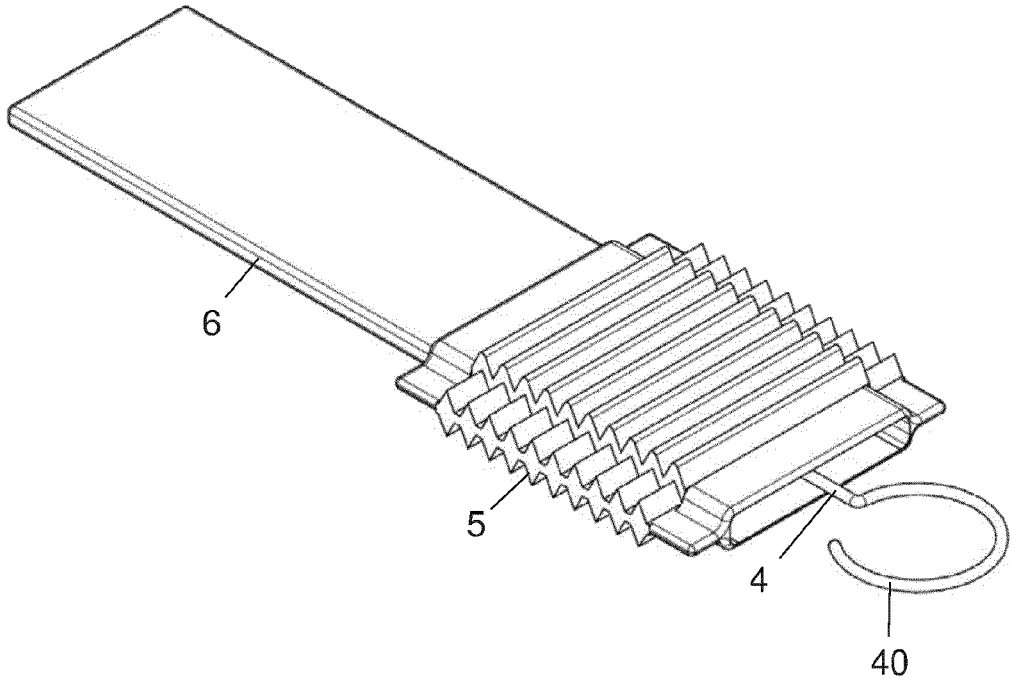
FIG. 9E shows a separate view of the tensioning element of the closure device, on tensioning of an actuator element in the form of a pulling element.
Figure 10A:
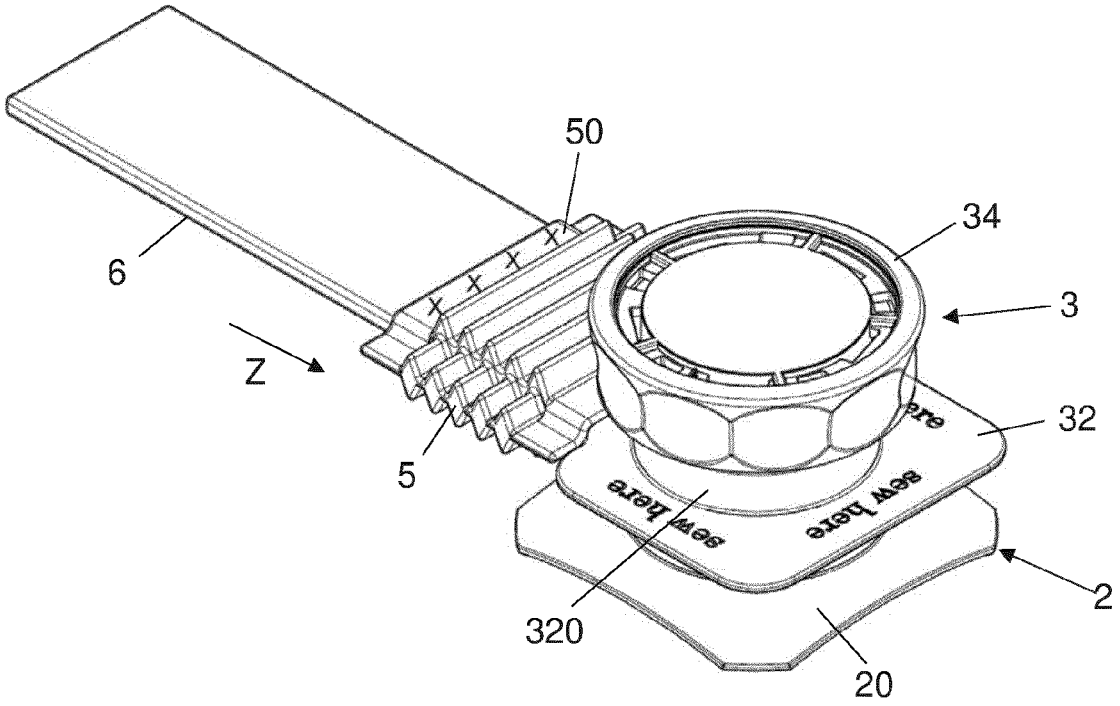
FIG. 10A shows a perspective view of the closure device, on further tensioning of an actuator element in the form of a pulling element.
Figure 10B:
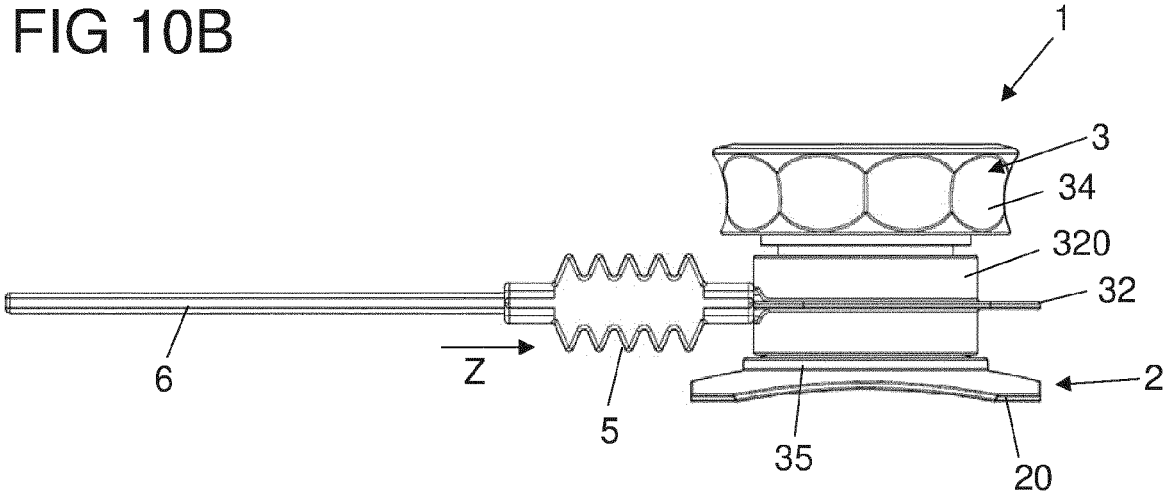
FIG. 10B shows a side view of the closure device, on further tensioning of an actuator element in the form of a pulling element.
Figure 10C:
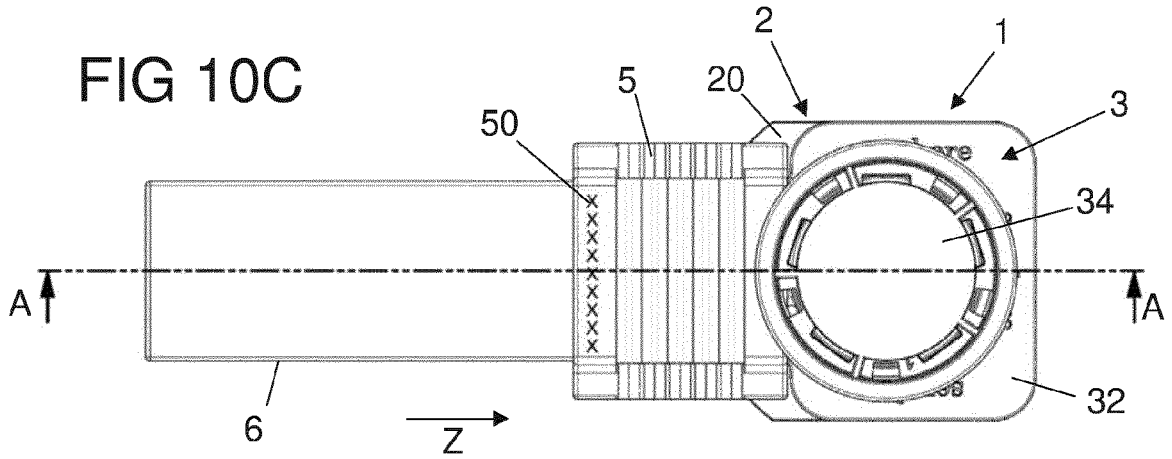
FIG. 10C shows a top view of the closure device, on further tensioning of an actuator element in the form of a pulling element.
Figure 10D:
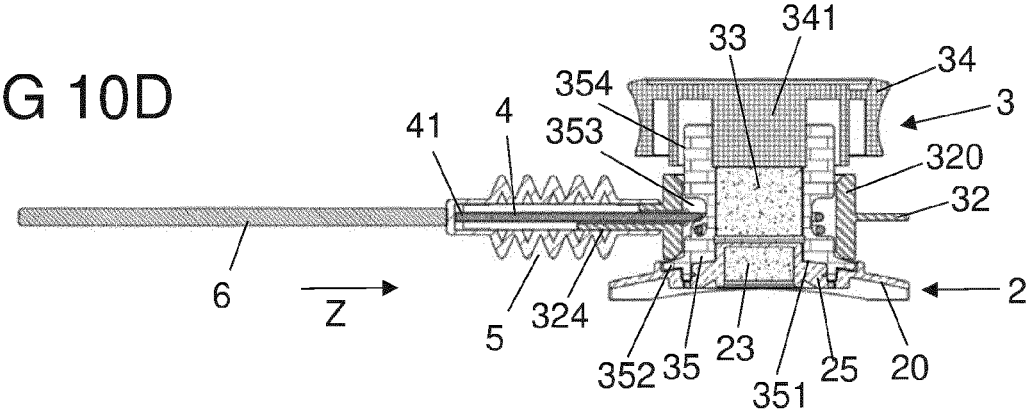
FIG. 10D shows a sectional view along line A-A of FIG. 10C.
Figure 10E:
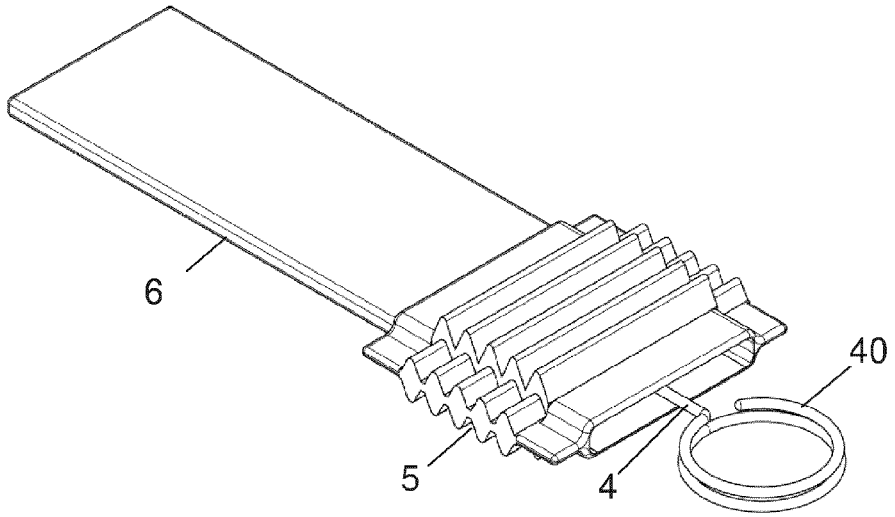
FIG. 10E shows a separate view of the tensioning element of the closure device, on further tensioning of an actuator element in the form of a pulling element.
Figure 11A:
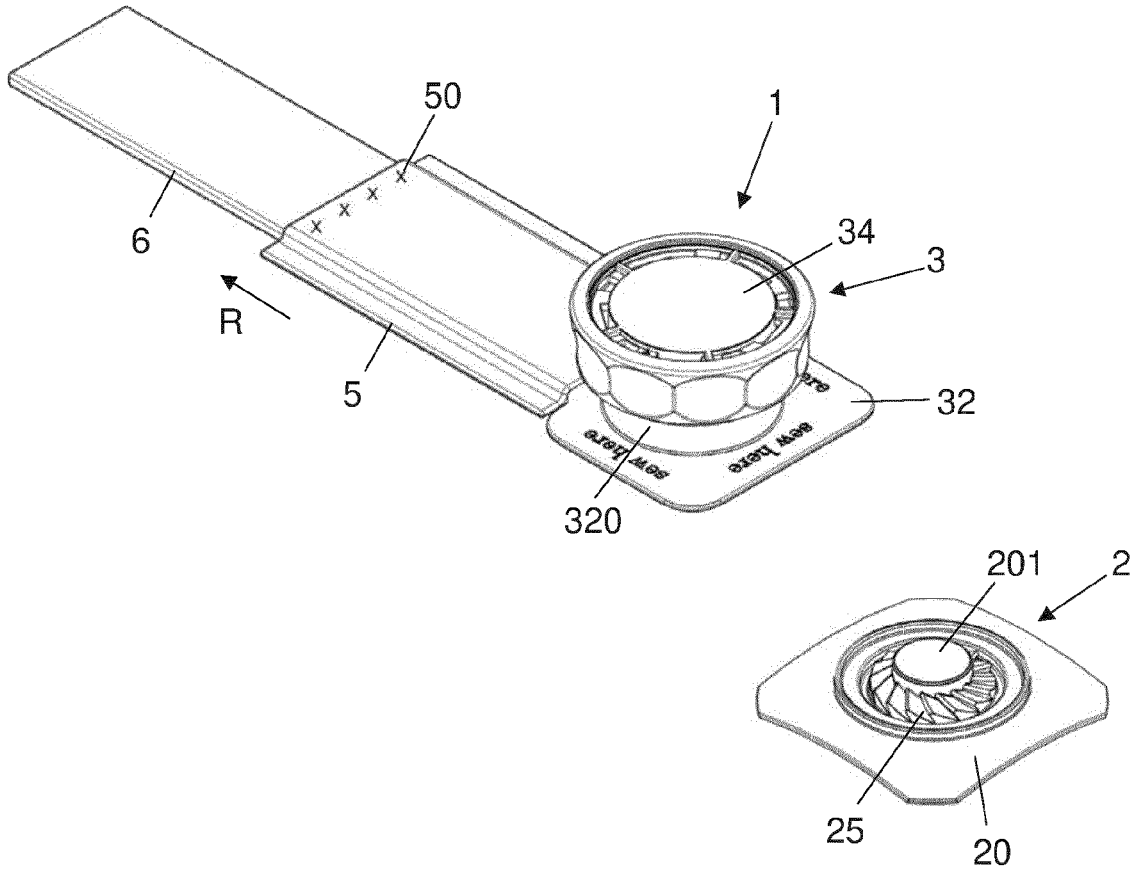
FIG. 11A shows a perspective view of the closure device in the open position.
Figure 11B:
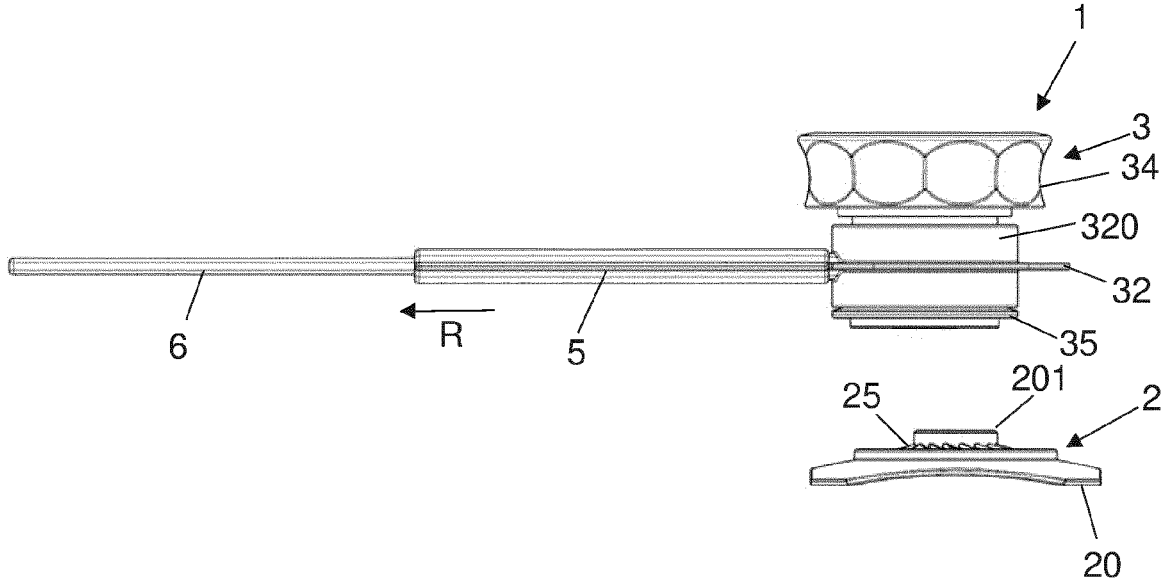
FIG. 11B shows a side view of the closure device in the open position.
Figure 11C:
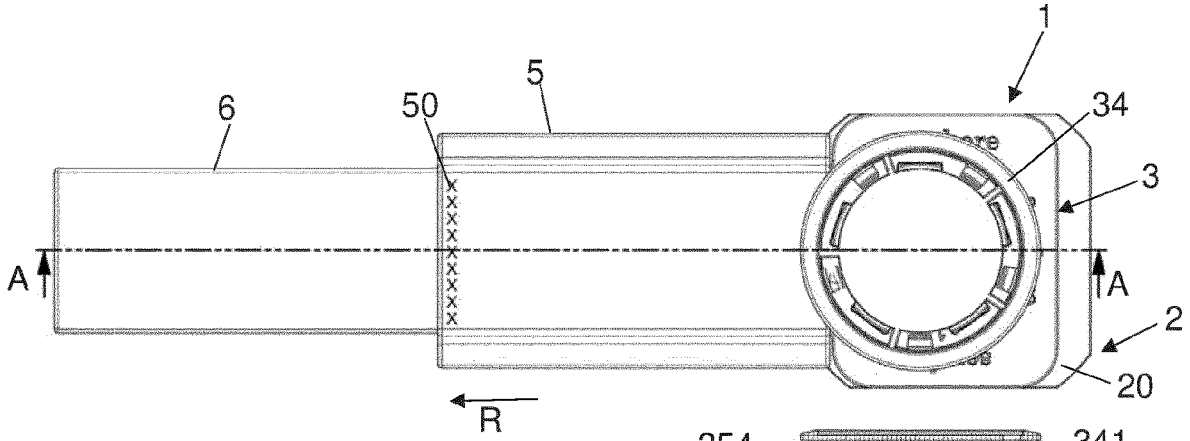
FIG. 11C shows a top view of the closure device in the open position.
Figure 11D:
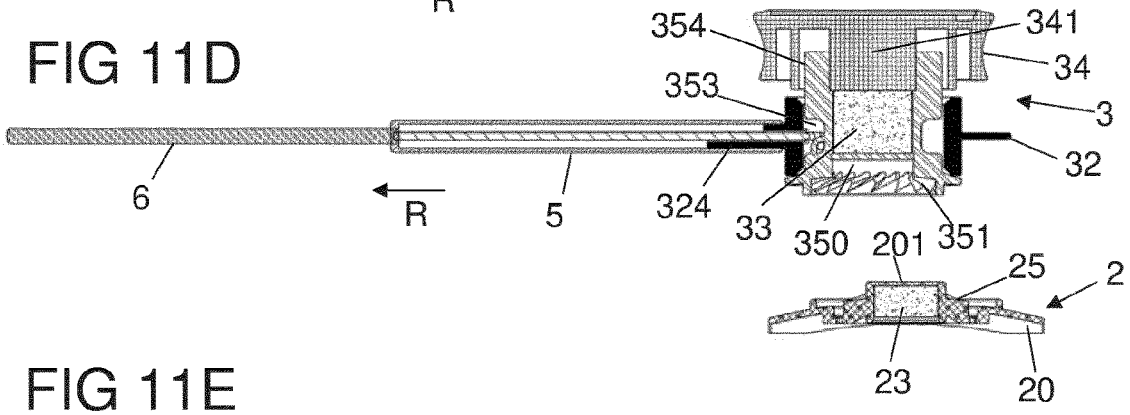
FIG. 11D shows a sectional view along line A-A of FIG. 11C.
Figure 11E:
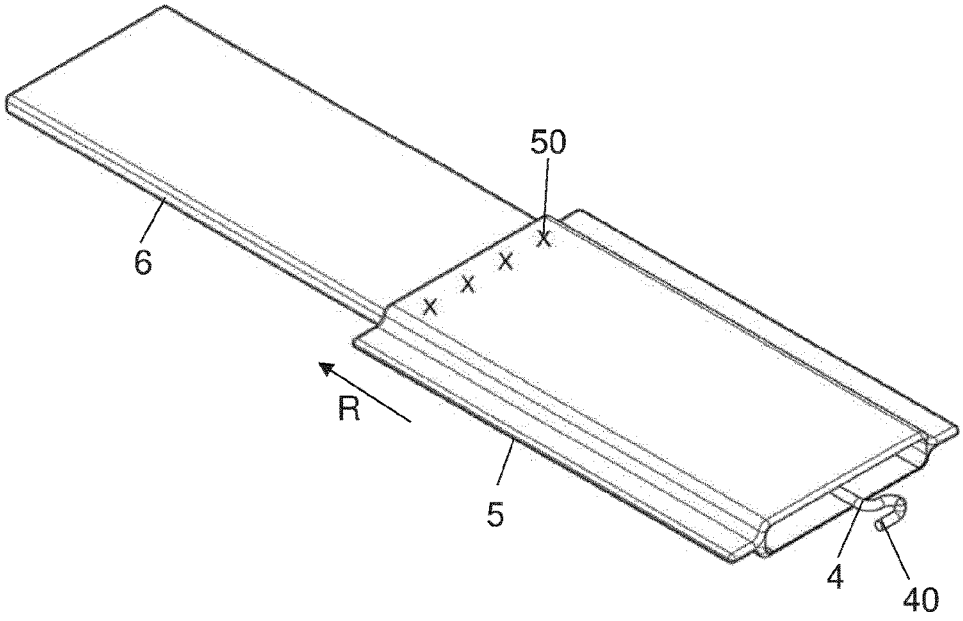
FIG. 11E shows a separate view of the tensioning element of the closure device, in the open position.
Figure 12:
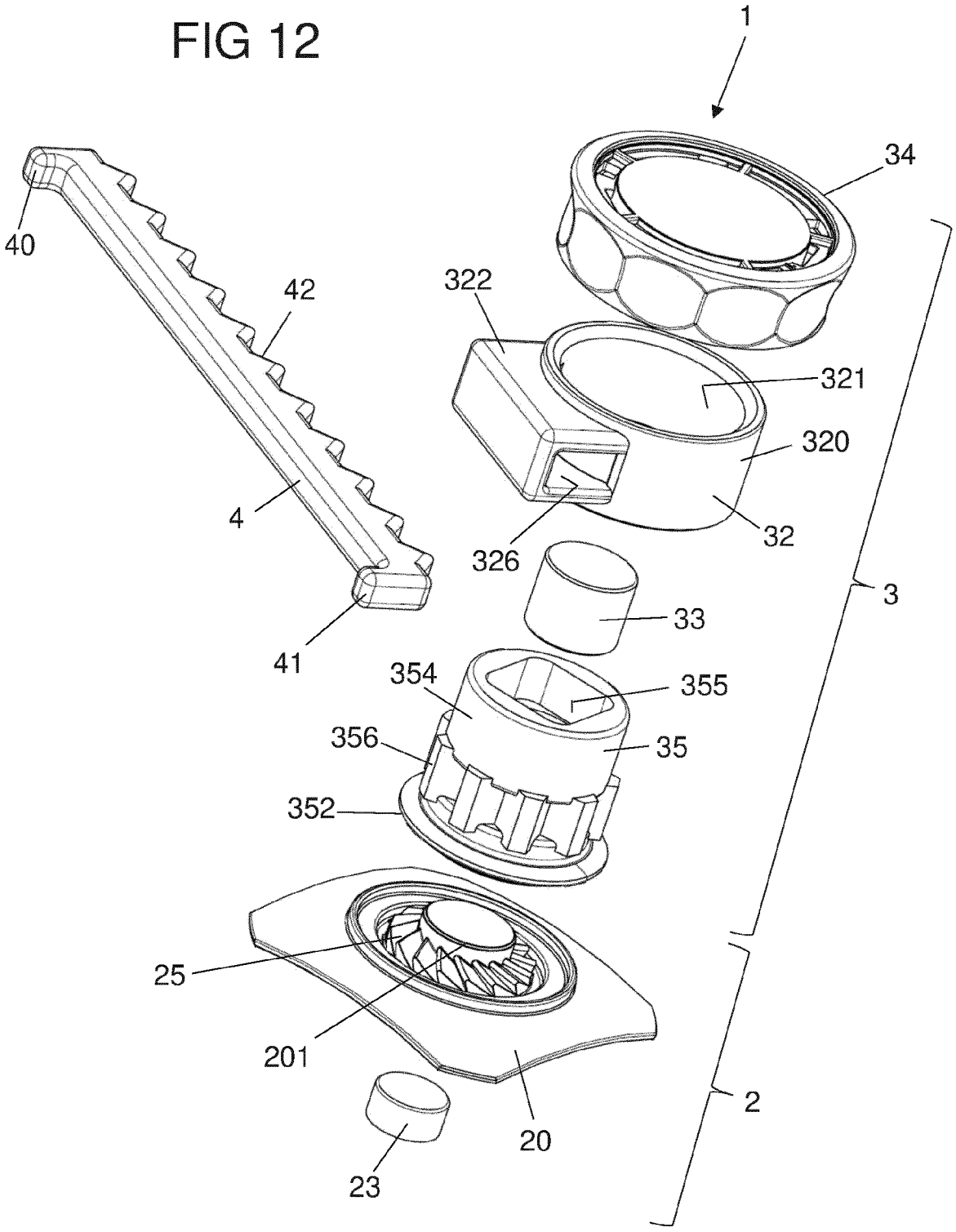
FIG. 12 shows an exploded view of another exemplary embodiment of a closure device, with an actuator element in the form of a toothed rack.
Figure 13:
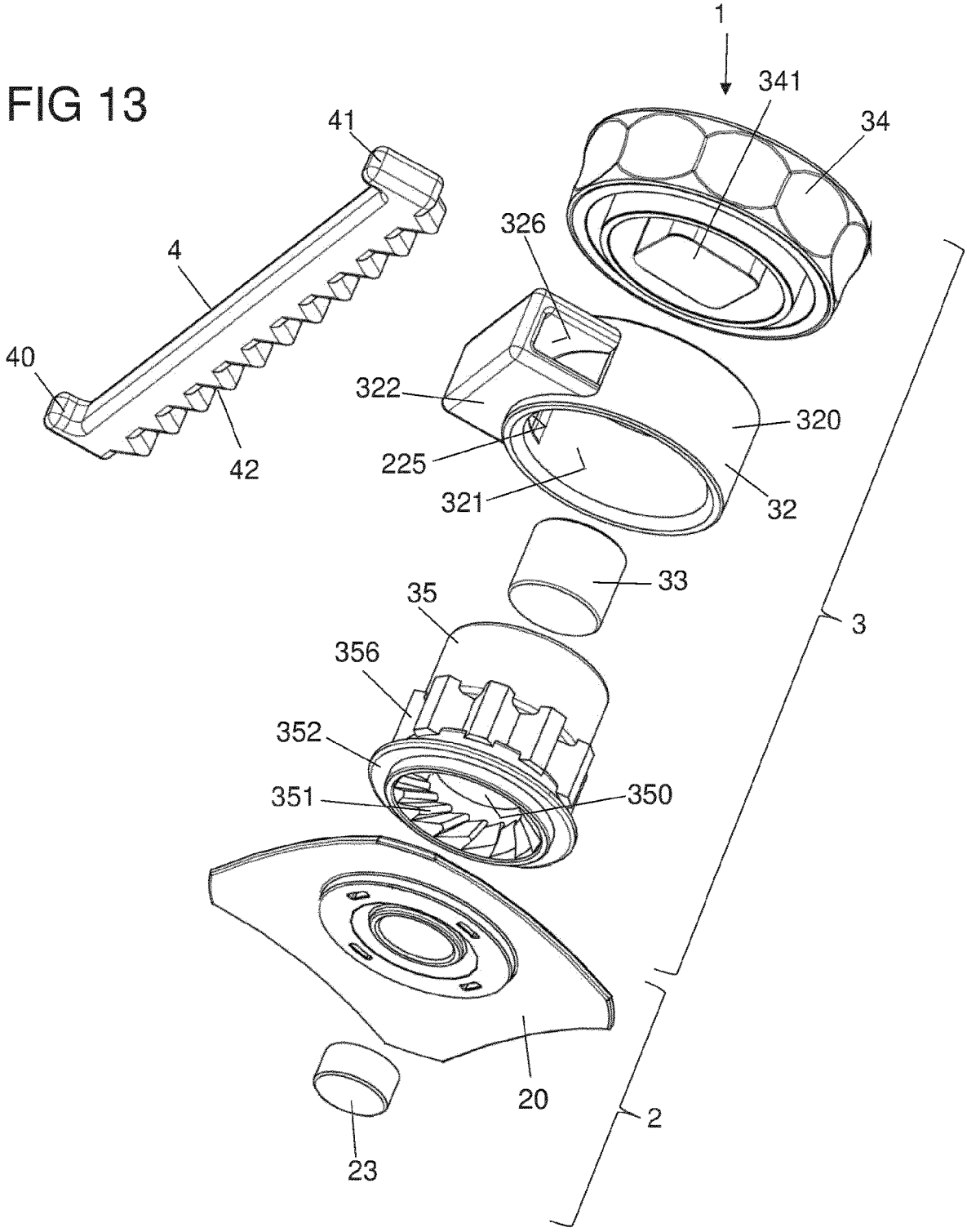
FIG. 13 shows another exploded view of the closure device.
Figure 14:
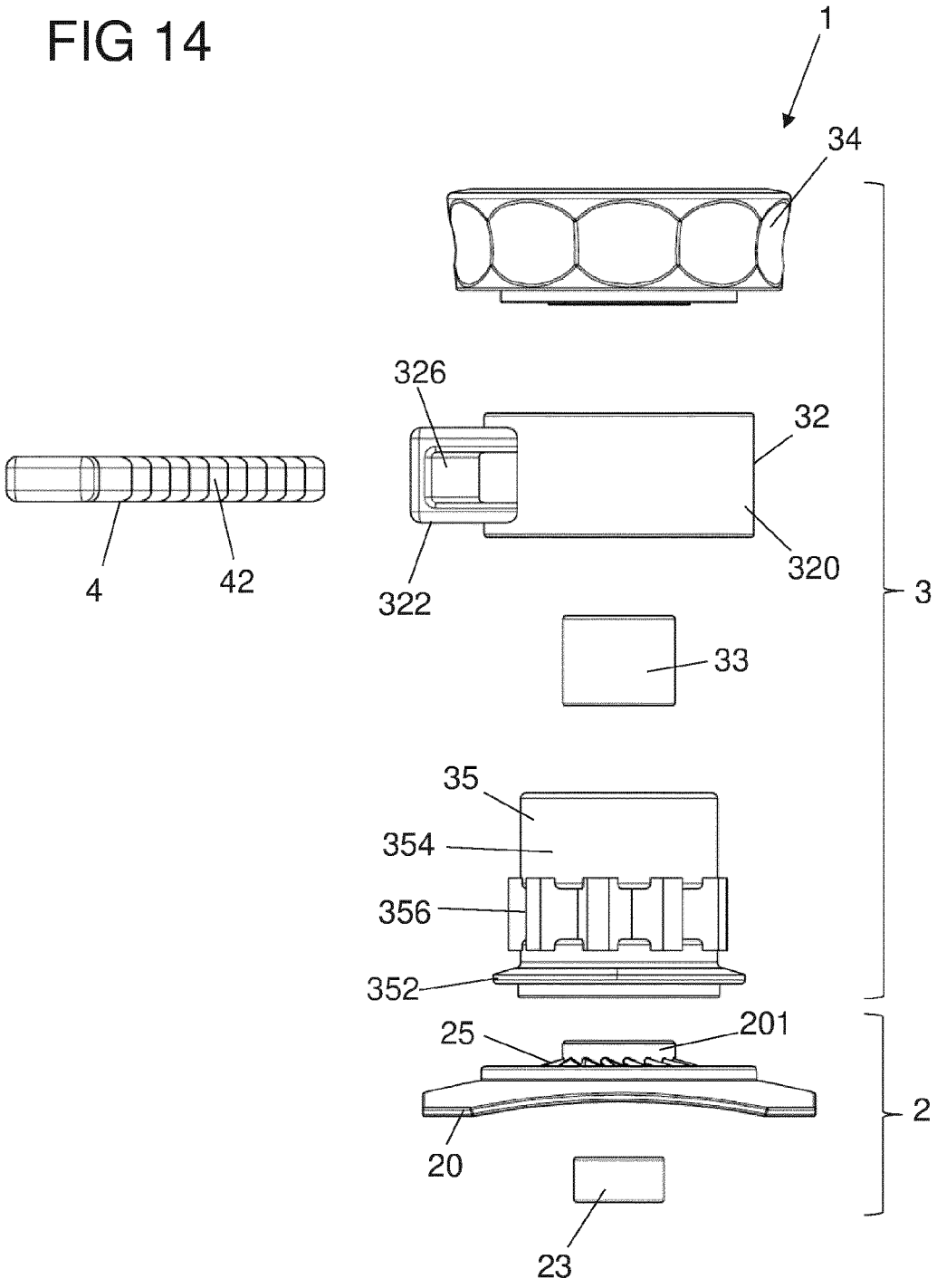
FIG. 14 shows a lateral exploded view of the closure device.

In the illustrated exemplary embodiment, the actuator element 4 in the form of the flexurally slack pulling element is connected to the rotary element 35 with one end 40, as can be taken from FIG. 8E in a synopsis with FIG. 8D, so that the actuator element 4 can be wound on the groove 353 of the rotary element 35 by rotating the rotary element 35.

In the illustrated exemplary embodiment, the actuating element 34 is non-rotatably connected to the rotary element 35. For this purpose, the actuating element 34 includes an engagement device 341 formed on a base surface 340 in the form of a pin polygonal in cross-section, which is of non-rotational-symmetrical shape and is configured to engage into an engagement device 355 in the form of an engagement opening on the bearing body 354 of the rotary element 35 and thus produce a non-rotatable connection between the actuating element 34 and the rotary element 35. By actuating the actuating element 34, the rotary element 35 can thus be rotated in the bearing opening 321 of the housing element in order to thereby adjust the actuator element 4 in the form of the pulling element, namely to wind the actuator element 4 in the form of the pulling element on the groove 353.

On a side facing the first closure part 2, the rotary element 35 has a toothing 351. When placing the closure parts 2, 3 against each other along the closing direction X, the toothing 351 of the rotary element 35 gets in engagement with the toothing 25 on the base body 20 of the first closure part 2, as this is shown in FIGS. 6A, 6B, 7A, 7B and FIGS. 8A-8E.

When the closure parts 2, 3 are placed against each other, the cylinder portion 201 on the base body 20 of the first closure part 2 engages into a central opening 350 of the rotary element 35 so that the rotary element 35 thereby is rotatably and axially movably mounted on the first closure part 2.

In the illustrated exemplary embodiment, both the toothing 351 of the rotary element 35 and the toothing 25 of the first closure part 2 have a sawtooth shape. In the closed position of the closure device 1, this provides for rotating the second closure part 3 in a winding direction V with respect to the first closure part 2 by means of the rotary element 35 and the actuating element 34, wherein the teeth of the toothings 25, 351 slide onto each other and are moved across each other, by axially deflecting the closure parts 2, 3 with respect to each other. The toothings 25, 351 thus provide a kind of freewheel, which provides for rotating the rotary element 35 in the winding direction V when the closure parts 2, 3 are placed against each other, in order to tension an actuator element 4 arranged on the rotary element 35, but blocks a movement against the winding direction V so that the actuator element 4 cannot be unwound against the winding direction V when the closure parts 2, 3 are placed against each other.

In the illustrated exemplary embodiment, the teeth of the toothings 25, 351 each form an undercut which effects that on loading of the closure parts 2, 3 with respect to each other against the winding direction V, the toothings 25, 351 are blockingly in engagement with each other, and thus a rotary movement of the rotary element 35 against the winding direction V with respect to the first closure part 2 is prevented. The engagement is non-rotatable, loadable and self-reinforcing, due to the undercut tooth flanks of the toothings 25, 351 cooperating under a load against the winding direction V.

In the illustrated exemplary embodiment, a tensioning element 5 in the form of an elastically deformable tube element is arranged on the housing element 32, which forms an interior space in which the actuator element 4 in the form of the flexurally slack pulling element is received. The tensioning element 5 is connected to the housing element 32 due to the fact that the engagement tab 324 engages into the tensioning element 5 and the tensioning element 5 for example is sewn to the engagement tab 324.

At an end located away from the housing element 32, the tensioning element 5 is connected to a for example textile object 6, which is to be adjusted via the closure device 1, in that the tensioning element 5 is sewn to the object 6 via a connecting seam 50 or is connected to the object 6 in some other way. The actuator element 4 in the form of the pulling element here is connected to the object 6 with an end 41 located away from the end 40 in such a way that by adjusting the actuator element 4, the object 6 can be adjusted relative to the closure device 1.

When placing the closure parts 2, 3 against each other, the toothing 351 on the inside of the opening 350 of the rotary element 35 gets in engagement with the toothing 25 around the cylinder portion 201 due to the magnetically attracting interaction of the magnetic elements 23, 33, which cylinder portion also gets in engagement with the opening 350 of the rotary element 35, as this is shown in FIGS. 8A to 8E.

Due to the non-rotatable connection between the actuating element 34 and the rotary element 35, the rotary element 35 is moved together with the actuating element 34 in the closed position during a rotation of the actuating element 34 in the winding direction V, and thus is rotated about the closing direction X. The toothings 25, 351 slide over each other, so that the rotary element 35 is rotated with respect to the first closure part 2, and the actuator element 4 in the form of the flexurally slack pulling element thus is wound onto the rotary element 35.

Due to the sawtooth-shaped, undercut configuration of the toothings 25, 351, a load introduced via the actuator element 4 against the winding direction V cannot lead to the rotary element 35 being rotated back. This is prevented by the engagement of the toothings 25, 351 into each other.

By rotating the rotary element 35 in the winding direction V, the actuator element 4 in the form of the flexurally slack pulling element can be wound onto the rotary element 35, as this is shown at the transition of FIGS. 8A-8C towards FIGS. 9A-9E and furthermore towards FIGS. 10A-10E. By winding the actuator element 4 onto the rotary element 35, the actuator element 4 is pulled towards the rotary element 35 with the end 41, which effects that the object 6 is pulled towards the closure device 1 in a pulling direction Z and the tensioning element 5 thereby is tensioned in the pulling direction Z by elastic deformation.

In the position shown in FIGS. 9A-9E, the actuator element 4 is wound onto the rotary element 35 in the region of the end 40 with almost one revolution. In the position shown in FIGS. 10A-10E, the actuator element 4 on the other hand is wound onto the rotary element 35 with approximately two revolutions, and correspondingly the tensioning element 5 is shortened in its length and braced in the pulling direction Z.

When the closure parts 2, 3 are to be detached from each other, the second closure part 3 can simply be withdrawn from the first closure part 2 against the closing direction X in a release direction L, as this is shown in FIGS. 11A to 11E, whereby the toothings 25, 351 get out of engagement with each other and the closure parts 2, 3 are separated from each other.

When the closure device 1 is opened by removing the closure parts 2, 3 from each other against the closing direction X, the actuator element 4 automatically is reset in a resetting direction R into an extended starting position due to the pretension of the tensioning element 5, in which starting position the object 6 in turn is away from the closure device 1 and the tensioning element 5 is relaxed. This is effected by rotating the rotary element 35 and the actuating element 34 connected thereto back against the winding direction V, which is easily possible in a smooth way, because the engagement between the toothings 25, 351 is eliminated in the open position.

The tensioning element 5 for example can be formed by an elastically deformable tube or a grommet. The tensioning element 5 for example can be formed from a rubber material or an elastomeric plastic material or a foam material.

The tensioning element 5 can be formed by a spring element, for example a metal spring, in particular a compression spring or a tension spring.

In an exemplary embodiment shown in FIGS. 12 to 17A-17D, an actuator element is formed by a rigid element in the form of a toothed rack with a toothing 42 formed thereon.

While the first closure part 2 substantially is formed identical in construction to the closure part 2 of the exemplary embodiment described above and includes a base body 20 with a cylinder portion 201 formed thereon and a toothing device 25 and a magnetic element 23, the second closure part 3 is configured for adjusting the actuator element 4 in the form of the rigid toothed rack 4.

In the illustrated exemplary embodiment, the second closure part 3 includes a rotary element 35 which with a bearing body 354 is rotatably received in a bearing opening 321 of a bearing collar 320 of a housing element 32. Via engagement devices 341, 355, the rotary element 35 is non-rotatably connected to an actuating element 34 in the form of a hand knob in such a way that by rotating the actuating element 34, the rotary element 35 can be rotated.

On the bearing body 354 of the rotary element 35 a circumferentially extending toothing 356 is formed, via which the rotary element 35 is in meshing engagement with the actuator element 4 in the form of the toothed rack. On the housing element 32, a guiding device 322 for receiving the actuator element 4 is formed, in which the actuator element 4 is adjustable, wherein the actuator element 4 is in meshing engagement with the rotary element 35 received in the bearing collar 320 via an opening 325 formed on the hollow cylindrical bearing collar 320, as this can be taken for example from FIG. 15D.

Figure 15A:
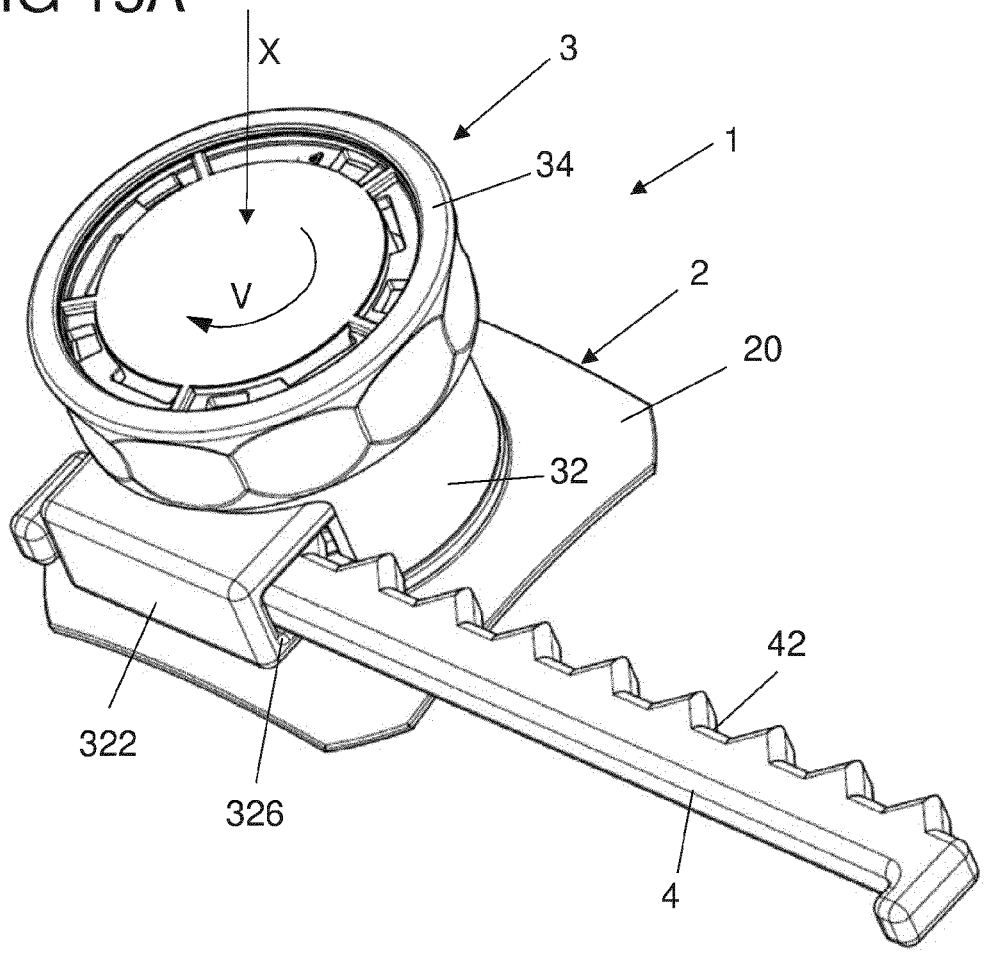
FIG. 15A shows a perspective view of the closure device in a closed position.
Figure 15B:
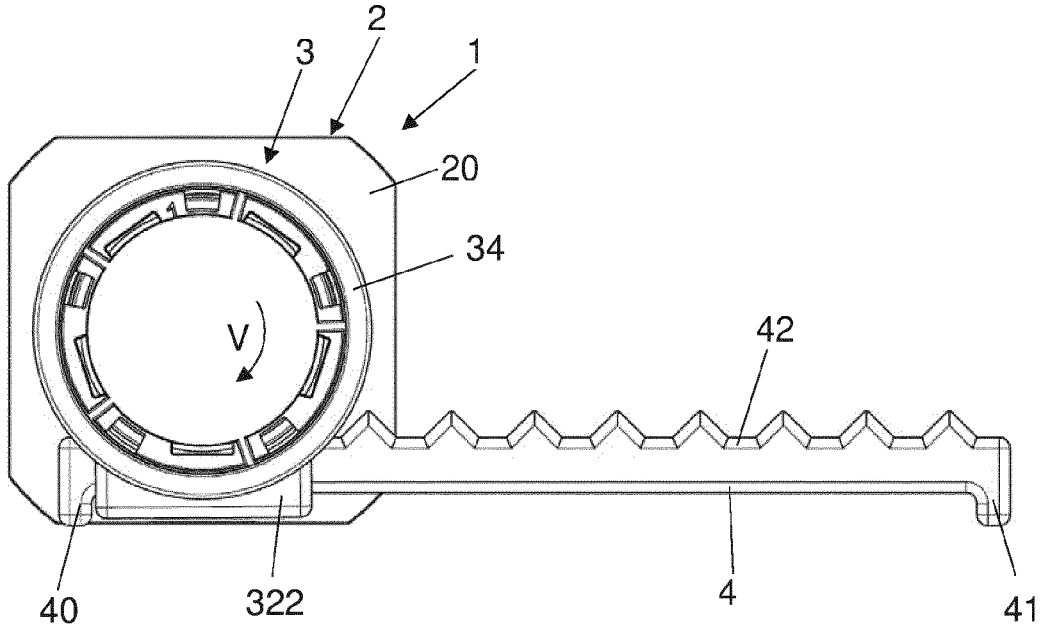
FIG. 15B shows a top view of the closure device in the closed position.
Figure 15C:
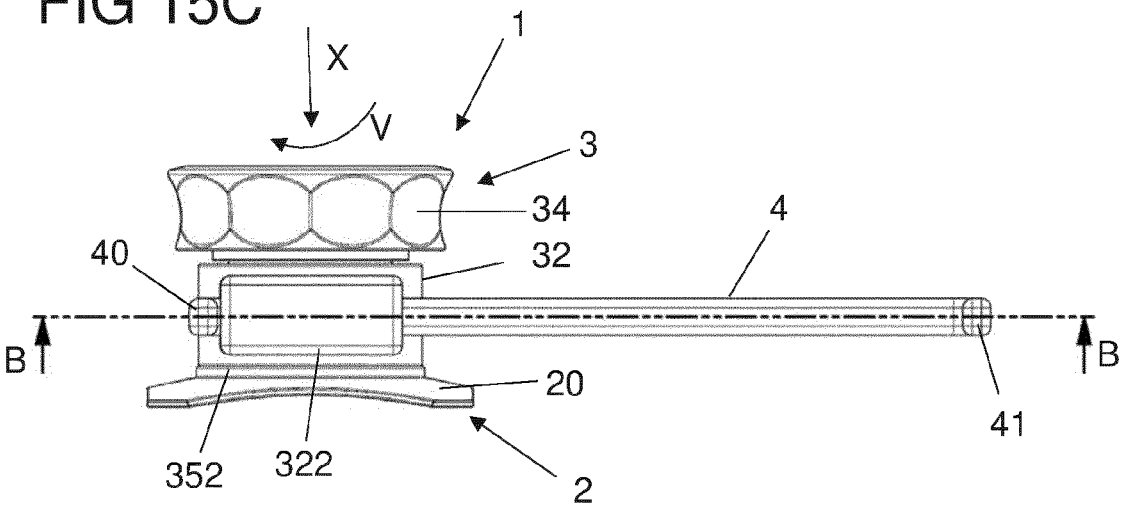
FIG. 15C shows a side view of the closure device in the closed position.
Figure 15D:
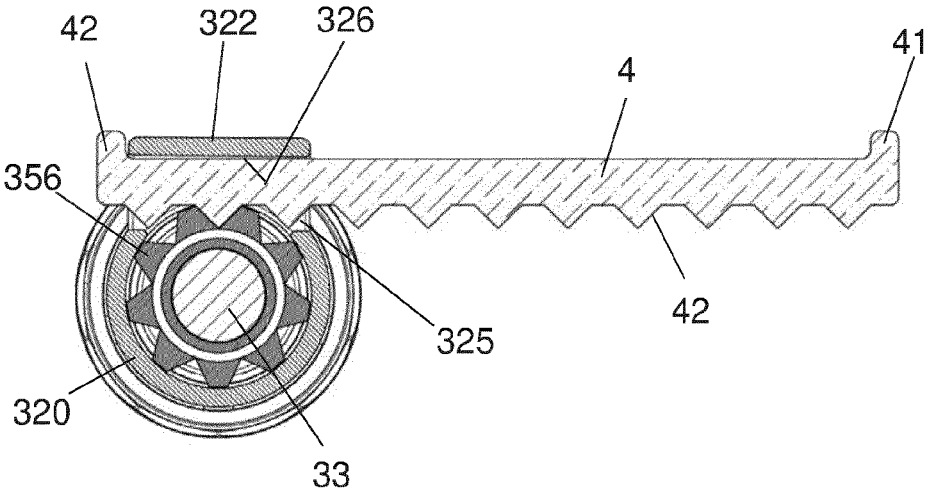
FIG. 15D shows a sectional view along line B-B of FIG. 15C.
Figure 16A:
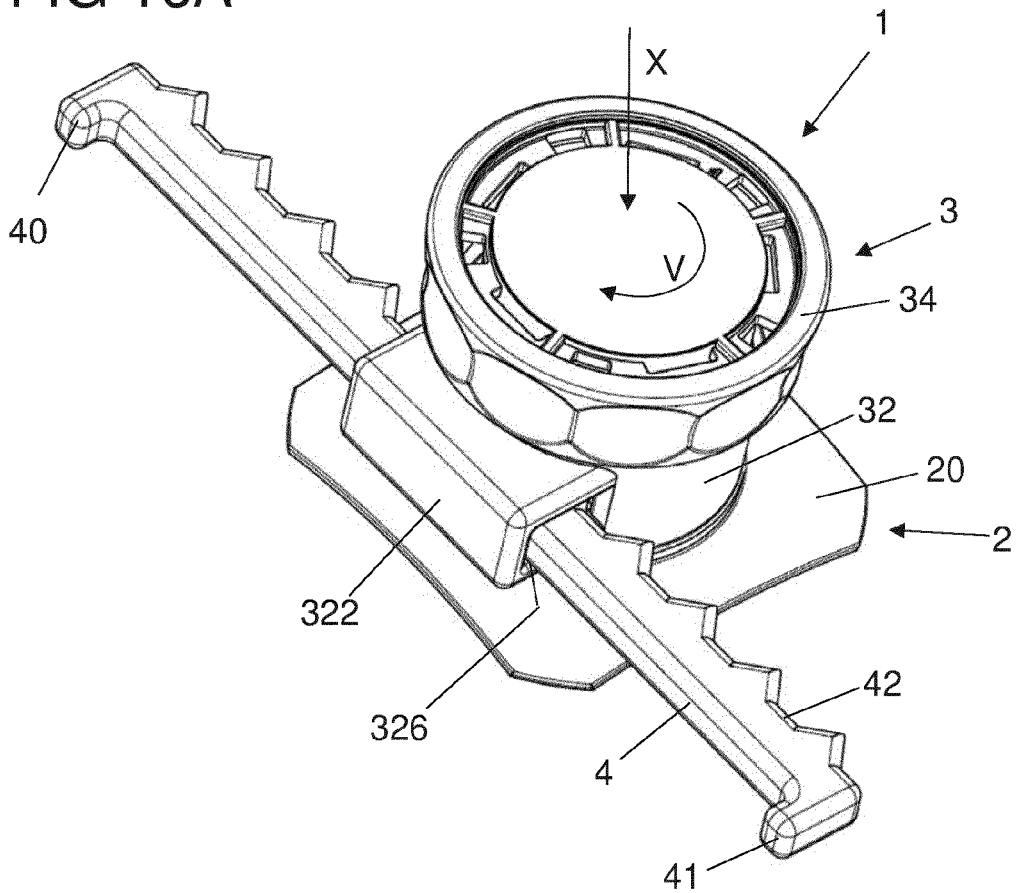
FIG. 16A shows a perspective view of the closure device, during an adjustment of the actuator element.
Figure 16B:
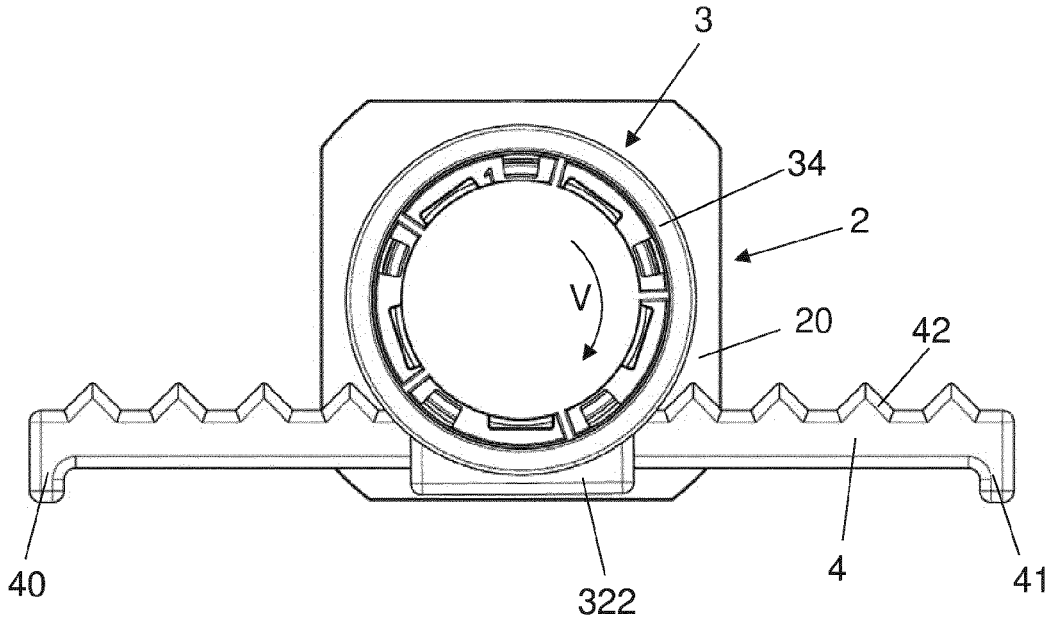
FIG. 16B shows a top view of the closure device, during an adjustment of the actuator element.
Figure 16C:
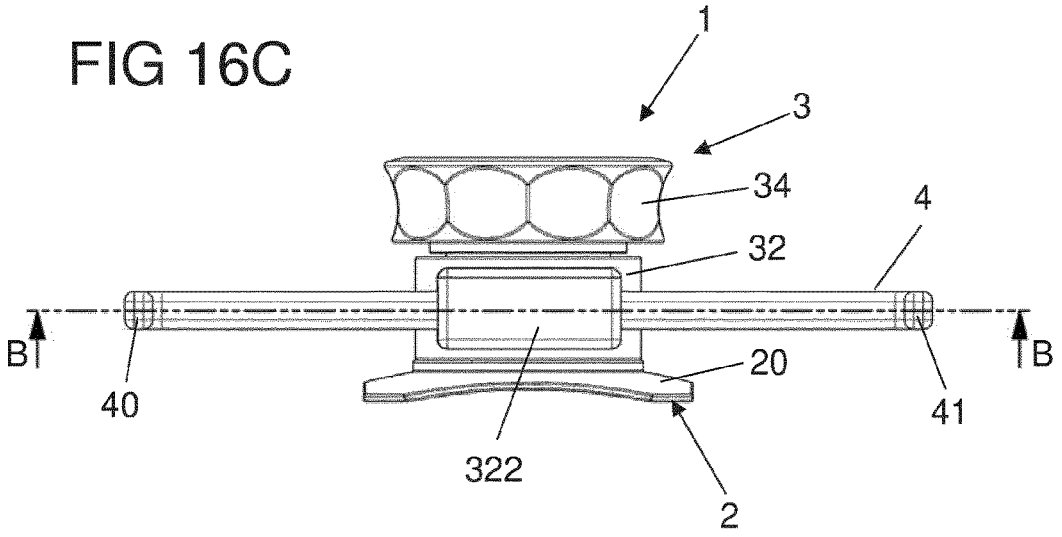
FIG. 16C shows a side view of the closure device, during an adjustment of the actuator element.
Figure 16D:
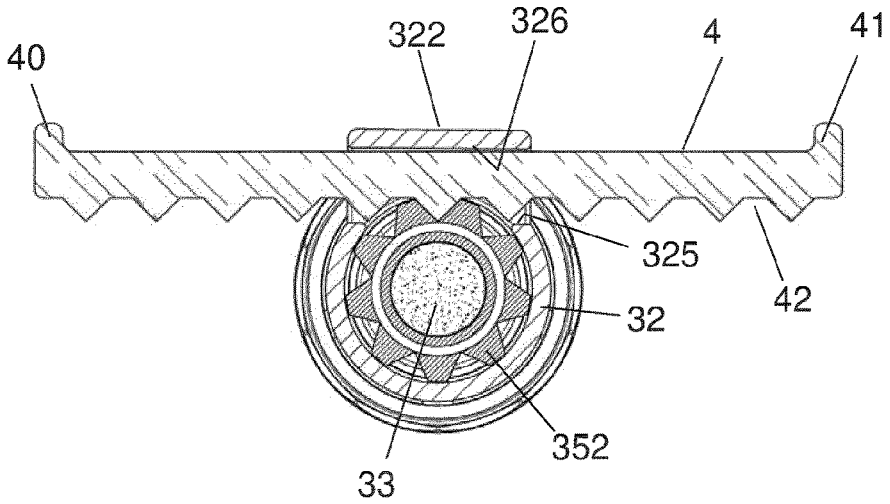
FIG. 16D shows a sectional view along line B-B of FIG. 16C.
Figure 17A:
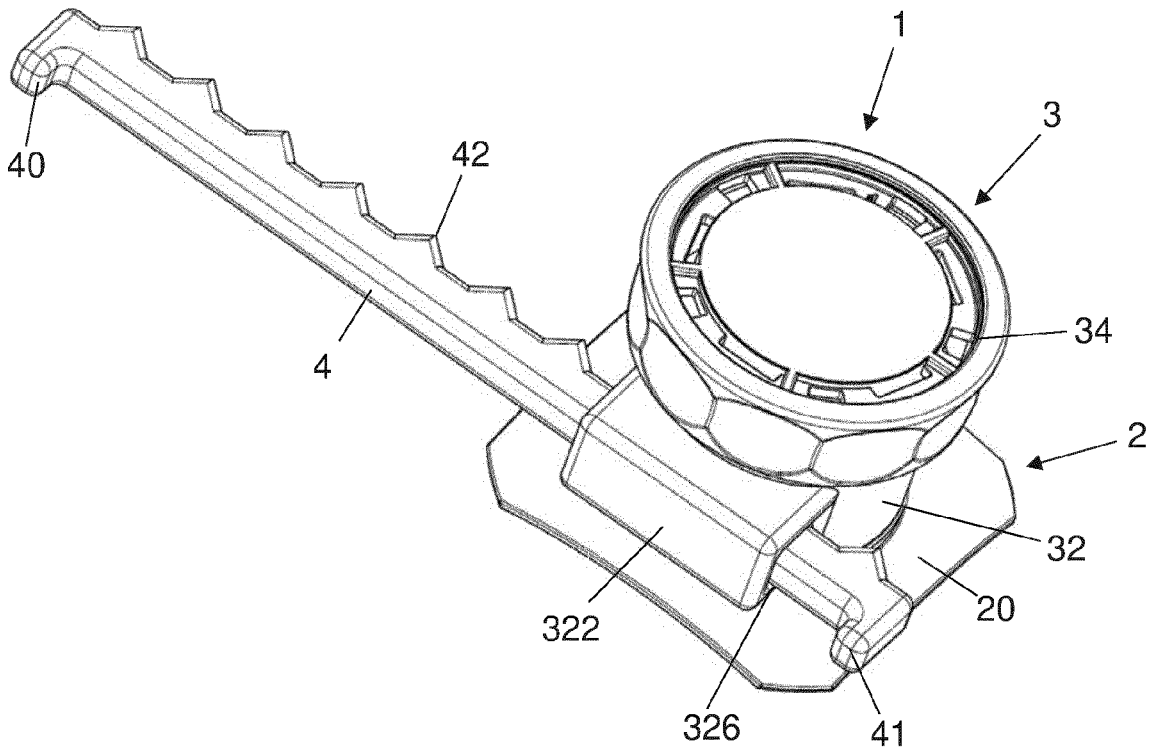
FIG. 17A shows a perspective view of the closure device, during a further adjustment of the actuator element.
Figure 17B:
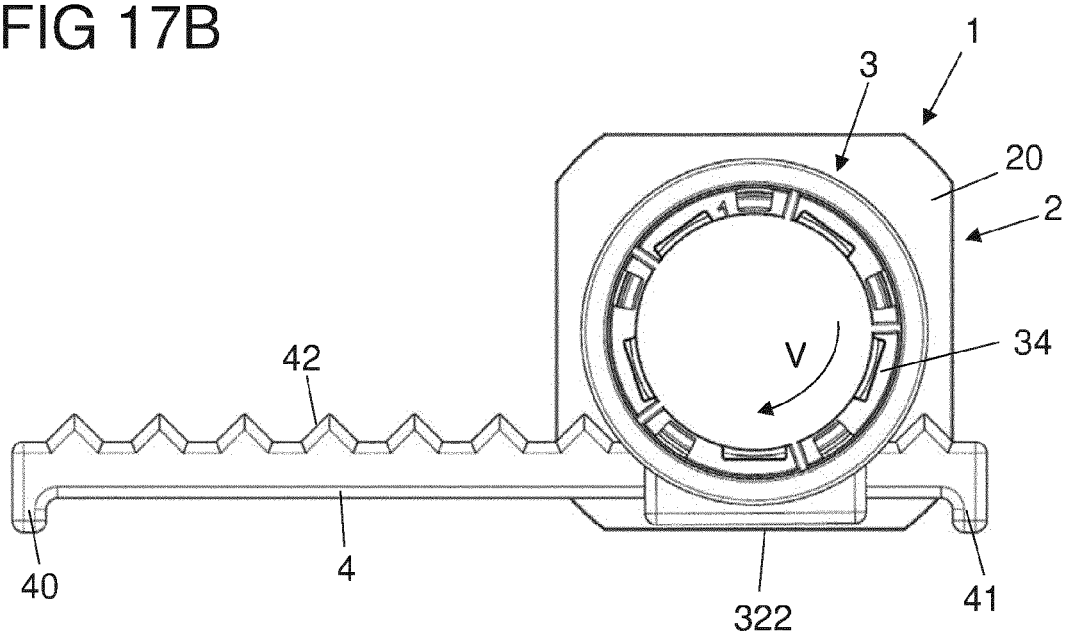
FIG. 17B shows a top view of the closure device, during a further adjustment of the actuator element.
Figure 17C:
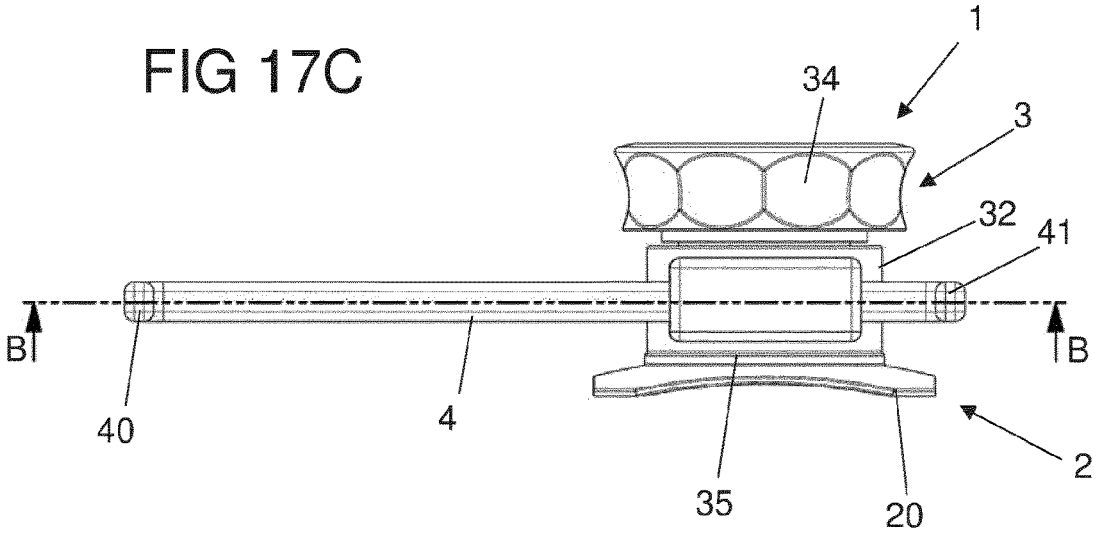
FIG. 17C shows a side view of the closure device, during a further adjustment of the actuator element.
Figure 17D:
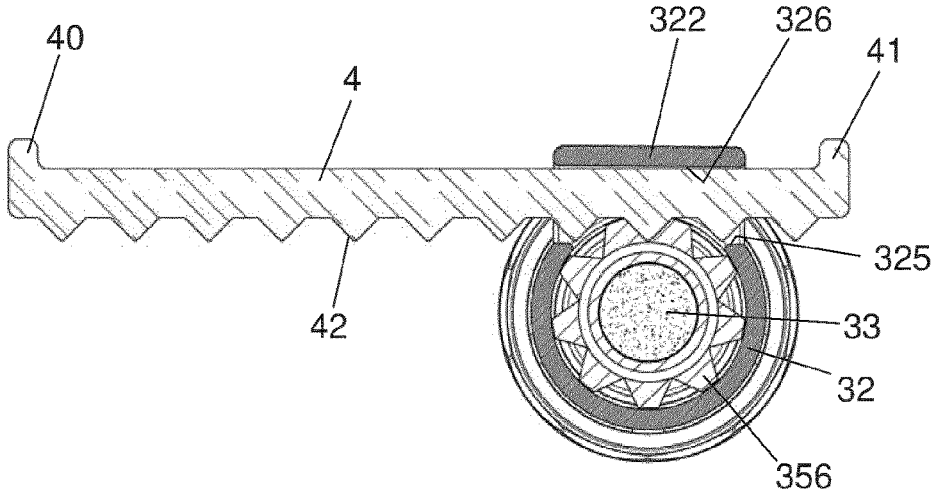
FIG. 17D shows a sectional view along line B-B of FIG. 17C.

On a side facing away from the actuating element 34, an abutment portion 352 in the form of an annular collar is formed on the rotary element 35, which in the closed position of the closure device 1 supportingly is in contact with the base body 20 of the first closure part 2, as this can be taken for example from FIG. 15C.

For closing, the closure parts 2, 3 can be placed against each other along the closing direction X, wherein the attachment is magnetically supported by the magnetic action of the magnetic elements 23, 33. In the closed position, shown in FIGS. 15A to 15D, the toothing devices 25, 351 of the closure parts 2, 3 are in meshing engagement with each other, so that—without actuation of the actuating element 34—the closure parts 2, 3 thereby are held in their rotary position with respect to each other.

By actuating the actuating element 34, the rotary element 35 can be rotated on the housing element 32 so that the actuator element 4 in the form of the toothed rack thereby is linearly adjusted relative to the housing element 32, as this is shown at the transition from FIGS. 15A-15D towards FIGS. 16A-16D and on towards FIGS. 17A-17D.

By rotating the rotary element 35, the actuator element 4 thus can be adjusted between two end positions. In a first end position, shown in FIGS. 15A-15D, the actuator element 4 is approached to the housing element 32 with an end 40. In a second end position, shown in FIGS. 17A-17D, the actuator element 4 on the other hand is approached to the housing element 32 with an end 41.

An object 6 is connected to the actuator element 4 so that the object 6 can be adjusted by adjusting the actuator element 4.

By detaching the closure parts 2, 3 from each other, the meshing engagement of the toothings 25, 351 is eliminated so that the actuator element 4 can be freely adjusted (without much force), by entraining the rotary element 35 and the actuating element 34.

In the exemplary embodiments described above, the toothing devices 25, 351 on the side of the first closure part 2 and of the second closure part 3 can be configured quite differently in principle so that in the closed position a positive hold (loadable at least up to a certain limit torque) is produced between the closure parts 2, 3.

In the described exemplary embodiments, the toothing devices 25, 351 are configured with undercuts in such a way that a movement of the rotary element 35 against the winding direction V is blocked in the closed position. However, this is to be understood only by way of example and can also be configured differently in principle.

In particular, the toothings can be configured such that the toothing devices 25, 351 provide for a rotation of the rotary element 35 with respect to the first closure part 2 in the winding direction V, but block an opposite rotary movement, wherein on exceedance of a limit torque opposite to the winding direction V a rotation becomes possible, for example by rounding or a suitable oblique position of the blocking tooth flanks. Alternatively, what is also conceivable is an embodiment in which the toothing devices 25, 351 block a rotation both in the winding direction V and against the winding direction V.

In the exemplary embodiments described above, the actuating element 34 and the rotary element 35 can be placed against the housing element 32 from different sides. By inserting the rotary element 35 into the bearing collar 320 of the housing element 32 and by placing the actuating element 34 against the rotary element 35, the second closure part 3 can be mounted, wherein in the mounted position the actuating element 34 and the abutment portion 352 of the rotary element 35 come to lie on different sides of the housing element 32. This results in an easy assembly of the closure part 3, in which the parts 32, 34, 35 can placed against each other and thus be connected to each other in a simple way.

The idea underlying the invention is not limited to the exemplary embodiments described above, but can also be realized in principle in an entirely different way.

For example, even in the configuration of the actuator element by a flexurally rigid pushing element, for example in the form of a toothed rack, a tensioning element in the form of an elastically deformable tube or the like can be present.

The tensioning element can also be formed by a spring element, for example a metal spring, in particular a compression spring or tension spring.

LIST OF REFERENCE NUMERALS

1 closure device
2 closure part
20 base body
201 cylinder portion
23 magnetic element
25 toothing device
3 closure part
32 housing element
320 bearing collar
321 bearing opening
322 guiding device
323 passage opening
324 engagement tab
325 opening
326 guide channel
33 magnetic element
34 actuating element
340 base surface
341 engagement device
35 rotary element
350 opening
351 toothing device
352 abutment portion (annular collar)
353 groove
354 bearing body
355 engagement device
356 toothing
4 actuator element
40, 41 end
42 toothing
5 tensioning element
50 connecting seam
51 interior space
6 object
R resetting device
V winding direction
X closing direction
Z pulling direction

The invention claimed is:

1. A closure device, comprising a first closure part and a second closure part, the first closure part and the second closure part being attachable to each other along a closing direction and are held on one another in a closed position, wherein the first closure part and the second closure part are releasable from each other for opening the closure device, wherein the second closure part includes a housing element with a bearing opening and a rotary element rotatably mounted in the bearing opening of the housing element, wherein the rotary element is operatively connected to an actuator element and is rotatable with respect to the second closure part for adjusting the actuator element along a winding direction, wherein the first closure part includes a first toothing device and the second closure part includes a second toothing device, wherein in the closed position of the closure device the first toothing device and the second toothing device are in engagement with each other in such a way that the first closure part and the second closure part are positively held with respect to each other along the winding direction, and wherein the first closure part and the second closure part each include at least one magnetic element for providing a force of magnetic attraction on placement of the closure parts against each other.

2. The closure device according to claim 1, wherein the actuator element is formed by a flexurally slack pulling element.

3. The closure device according to claim 1, wherein the actuator element is formed by of a toothed rack with a first toothing arranged thereon.

4. The closure device according to claim 3, wherein the rotary element includes a second toothing which is in engagement with the first toothing of the actuator element formed as a toothed rack.

5. The closure device according to claim 1, wherein the second closure part includes an actuating element which is operatively connected to the rotary element and can be actuated for rotating the rotary element.

6. The closure device according to claim 5, wherein the actuating element includes a first engagement device and the rotary element a second engagement device, wherein the first engagement device and the second engagement device are in engagement with each other for non-rotatably connecting the actuating element and the rotary element to each other.

7. The closure device according to claim 5, wherein the rotary element includes an abutment portion which the rotary element can be placed against the first closure part, wherein the actuating element is arranged on a first side of the housing element and the abutment portion is arranged on a second side of the housing element facing away from the first side.

8. The closure device according to claim 1, wherein the second toothing device is arranged on the rotary element.

9. The closure device according to claim 1, wherein in the closed position the second closure part is rotatable with respect to the first closure part in the winding direction, but a rotation of the second closure part with respect to the first closure part opposite to the winding direction is blocked.

10. The closure device according to claim 1, wherein the first closure part includes a cylinder portion which in the closed position engages into an opening of the rotary element for rotatably mounting the rotary element on the first closure part.

11. The closure device according to claim 1, wherein the housing element includes a passage opening through which the actuator element is extended.

12. The closure device according to claim 11, wherein the housing element includes a guiding device for guiding the actuator element towards the passage opening.

13. The closure device according to claim 1, further comprising a tensioning element which is elastically deformable during an adjustment of the actuator element.

14. The closure device according to claim 13, wherein the tensioning element is connected to the housing element.

15. The closure device according to claim 13, wherein the tensioning element is operatively connected to the actuator element in such a way that during an adjustment of the actuator element, the tensioning element is tensioned in a first direction and supports resetting of the actuator element in a second direction opposite to the first direction by a tensioning force.

16. The closure device according to claim 13, wherein the tensioning element encloses an interior space in which the actuator element is at least sectionally extended.

17. The closure device according to claim 13, wherein the tensioning element is arranged outside the bearing opening of the housing element.

* * * * *